US007571710B2

(12) United States Patent
Fukami et al.

(10) Patent No.: US 7,571,710 B2
(45) Date of Patent: Aug. 11, 2009

(54) THROTTLE VALVE CONTROLLER AND ENGINE

(75) Inventors: Yoji Fukami, Kakogawa (JP); Satoru Sakanaka, Akashi (JP); Tatsuya Hirokami, Osaka (JP); Mitsuhiro Yazaki, Kakogawa (JP)

(73) Assignee: Kawasaki Jukogyo Kabushiki Kaisha, Kobe-Shi (JP)

( * ) Notice: Subject to any disclaimer, the term of this patent is extended or adjusted under 35 U.S.C. 154(b) by 0 days.

(21) Appl. No.: 11/705,830

(22) Filed: Feb. 12, 2007

(65) Prior Publication Data

US 2007/0199541 A1 Aug. 30, 2007

(30) Foreign Application Priority Data

Feb. 13, 2006 (JP) ..... 2006-035516

(51) Int. Cl.
*F02D 9/02* (2006.01)
*F02D 41/00* (2006.01)
*F02D 11/10* (2006.01)

(52) U.S. Cl. ..... 123/342; 123/361; 123/397; 123/399

(58) Field of Classification Search ..... 123/395, 123/396, 399, 403, 337, 361, 397, 398, 400, 123/342

See application file for complete search history.

(56) References Cited

U.S. PATENT DOCUMENTS 4,086,900 A * 5/1978 Marsh ..... 123/198 D
4,304,202 A * 12/1981 Schofield ..... 123/363
4,362,138 A * 12/1982 Krueger et al. ..... 123/342
4,401,077 A * 8/1983 Earl ..... 123/376
4,526,060 A * 7/1985 Watanabe ..... 475/4
4,727,840 A * 3/1988 Nishida et al. ..... 123/399
4,932,375 A * 6/1990 Burney ..... 123/361
4,995,363 A * 2/1991 Terazawa et al. ..... 123/399
5,040,507 A * 8/1991 Hayes et al. ..... 123/339.2
5,152,360 A * 10/1992 Haefner et al. ..... 180/197
5,161,507 A * 11/1992 Terazawa et al. ..... 123/399
5,168,951 A * 12/1992 Sugiura et al. ..... 180/197
5,235,948 A * 8/1993 Grant et al. ..... 123/342

(Continued)

FOREIGN PATENT DOCUMENTS

JP HEI 3-64694 9/1983

(Continued)

*Primary Examiner*—Stephen K Cronin
*Assistant Examiner*—Sizo B Vilakazi
(74) *Attorney, Agent, or Firm*—Alleman Hall McCoy Russell & Tuttle LLP

(57) ABSTRACT

A throttle valve controller configured to control opening and closing of a throttle valve disposed in an air-intake passage of a throttle body coupled to an engine, including an input member that is rotatable in association with a rider's hand operation, a power transmission device with an input part thereof coupled to the input member, an output member that is coupled to an output part of the power transmission device and causes the throttle valve to rotate in association therewith, an actuator configured to drive the power transmission device to cause the output member to rotate relative to the input member to change a rotational ratio of the output member to the input member independently of the hand operation, and a movable stopper configured to change and restrict a rotational range of the input member in a closing direction of the throttle valve.

9 Claims, 18 Drawing Sheets

U.S. PATENT DOCUMENTS 5,297,521 A * 3/1994 Sasaki et al. ..... 123/396
5,778,853 A * 7/1998 Saito ..... 123/396
7,156,074 B2 * 1/2007 Hanasato ..... 123/399
7,261,083 B2 * 8/2007 Kondo ..... 123/399
7,311,082 B2 * 12/2007 Yokoi ..... 123/399
2004/0129253 A1 * 7/2004 Ozeki et al. ..... 123/399

FOREIGN PATENT DOCUMENTS

JP HEI 2-5716 1/1990

* cited by examiner

THROTTLE VALVE CONTROLLER AND ENGINE

TECHNICAL FIELD

The present invention relates to a throttle valve controller that is configured to control opening and closing of a throttle valve disposed in an air-intake passage of a throttle body coupled to an engine, and the engine.

BACKGROUND ART

In conventional motorcycles, a throttle body is coupled to an intake port of an engine, and a butterfly throttle valve disposed in an air-intake passage of the throttle body is controlled to be opened and closed, thereby controlling an amount of air taken in from outside and supplied to the engine. The throttle valve is opened and closed in association with a rider's hand operation of a throttle grip of the motorcycle. If a change amount in an opening degree of the throttle valve in response to the rider's throttle grip operation is large, then the amount of air varies significantly, causing the rider to feel discomfort during travel of the motorcycle. If the rider quickly closes the throttle grip to close the throttle valve, then the amount of air becomes insufficient for stable combustion. As a result, gas exhausting efficiency decreases.

As a solution to this, there has been disclosed a throttle valve controller configured to cause a motor to open and close the throttle valve in addition to the rider's hand operation to enable phase angle control of the throttle valve (see e.g., Japanese Laid-Open Patent Application Publication No. Hei. 2-5716 or Publication of Japanese Examined Patent Application No. Hei. 3-64694). The throttle valve controller is configured to calculate an optimal target opening degree of the throttle valve depending on an operating state of a vehicle and to cause a motor to electronically control the throttle valve to minimize a deviation between a valve opening degree in response to the rider's hand-operation and the target opening degree.

However, if the motor does not correctly operate and unexpectedly stops in a state where the throttle valve is driven to be opened by the motor, then the throttle valve will be left open by an excess phase angle due to the stopping of the motor. Under this condition, if the rider returns the throttle grip to a position corresponding to a fully closed position of the throttle valve, the throttle valve may remain opened by the excess phase angle, which may not correspond to the suitable throttle position for an idling engine speed in a normal state. As a result, gas exhausting efficiency and fuel consumption efficiency decrease.

SUMMARY OF THE INVENTION

The present invention addresses the above described conditions, and an object of the present invention is to provide a throttle valve controller capable of returning a throttle valve to an opening degree corresponding to an idling engine speed in a normal state even when a motor for controlling the throttle valve does not correctly operate and unexpectedly stops, causing the throttle valve to be left open by an excess phase angle, and an engine equipped with the throttle valve controller.

According to a first aspect of the present invention, there is provided a throttle valve controller configured to control opening and closing of a throttle valve disposed in an air-intake passage of a throttle body coupled to an engine, the throttle valve controller comprising an input member that is rotatable in association with a rider's hand operation; a power transmission device with an input part thereof coupled to the input member; an output member that is coupled to an output part of the power transmission device and causes the throttle valve to rotate in association therewith; an actuator configured to drive the power transmission device to cause the output member to rotate relative to the input member to change a rotational ratio of the output member to the input member independently of the rider's hand operation; and a movable stopper configured to change and restrict a rotational range of the input member in a closing direction of the throttle valve.

In such a construction, the movable stopper is able to change the rotational range of the input member if the actuator does not correctly operate and unexpectedly stops in the state where the actuator causes the output member to rotate relative to the input member to open the throttle valve, the throttle valve will be left open by an excess phase angle in an opening direction thereof. Therefore, the rider is able to further rotate the input member by hand operation in the closing direction to cancel the excess phase angle, thus returning the throttle valve to an idling opening degree corresponding to an idling engine speed of the engine in a normal state.

The movable stopper may be configured to be able to be switched from a restricting state that restricts the rotational range of the input member to a non-restricting state that does not restrict the rotational range.

In such a construction, since the stopper is configured to be switched to the non-restricting state even when the actuator does not correctly operate and unexpectedly stops, the rider rotates the input member by hand operation to control the opening degree of the throttle valve, thus returning the throttle valve to the idling opening degree in the normal state.

The movable stopper may be configured to contact a contact portion rotatable integrally with the input member to restrict rotation of the input member in the restricting state and may be configured to be retracted from a rotational track of the contact portion outside the rotational track in the non-restricting state.

In such a construction, the input member can be switched between the restricting state and the non-restricting state simply by extended/retracted operations of the movable stopper.

The movable stopper may be configured to contact a contact portion rotatable integrally with the input member to restrict rotation of the input member and may be configured to be retracted in the closing direction of the throttle valve on a rotational track of the contact portion.

In such a construction, since the movable stopper is retracted in the closing direction of the throttle valve on the rotational track of the contact portion, the movable stopper can be maintained in the restricting state so as to increase a rotational range of the input member in the closing direction of the throttle valve. Therefore, the rotational range of the input member in the closing direction of the throttle valve can be suitably changed.

The movable stopper may be configured to be retracted by a predetermined pressing force applied from the contact portion and to maintain a retracted state, and may be configured to be extended to be in a restricting state that restricts the rotational range of the input shaft by a return member for releasing the retracted state of the movable stopper.

In such a construction, when the rider rotates the input member by hand operation with a predetermined force or more, the contact portion applies a pressing force to retract the movable stopper. Because the retracted state of the movable stopper can be maintained, the changed rotational range of the input member can be maintained after the movable stopper is retracted. Furthermore, the movable stopper can be reset to be in an initial extended state by using the return member.

The movable stopper may include a stopper portion configured to be applied with a force to be in an extended state; a stop portion configured to stop the stopper portion in the retracted state when the stopper portion is retracted against the force; and a release portion configured to serve as the return member, the release portion being configured to be operated by a rider's hand to release the stop state of the stop portion.

In such a construction, since the movable stopper is configured to mechanically stop or release the stopper portion in or from the retracted state independently of an electric system, it can be extended or retracted stably without being negatively affected by electric or software errors.

The movable stopper may include a hydraulic cylinder, a stopper portion that is extensible and retractable by an oil pressure of the hydraulic cylinder; a first relief valve configured to outflow oil from the hydraulic cylinder to cause the stopper portion to be retracted when a pressing force is applied from the contact portion to the stopper portion; and a second relief valve configured to inflow oil into the hydraulic cylinder to cause the stopper portion to be extended by a load of a return piston serving as the return member and being configured to be operated by the rider's hand.

In such a construction, since the movable stopper is configured to hydraulically stop or release the stopper portion in or from the retracted state independently of the electric system, it can be extended or retracted stably without being negatively affected by electric or software errors and substantially without occurrence of mechanical wear, etc.

The throttle valve controller may further comprise a hand-operation angle sensor configured to detect a rotational angle of the input member; a valve angle sensor configured to detect an actual rotational angle of the throttle valve; a valve opening degree calculator configured to calculate and determine a target opening degree of the throttle valve based on a detected value from the hand-operation angle sensor; a movable stopper drive unit configured to extend and retract the movable stopper; and a stopper controller configured to cause the movable stopper drive unit to move the movable stopper to increase a rotational angle in the closing direction of the throttle valve when the target opening degree calculated by the valve opening degree calculator is a fully closed position and the actual rotational angle of the throttle valve that is detected by the valve angle sensor is an opening degree more than a predetermined angle.

In the above construction, the movable stopper can be electronically controlled to be retracted in a case where the actual opening degree of the throttle valve is open to an opening degree more than a predetermined angle despite the fact that the target opening degree of the throttle valve calculated by the valve opening degree calculator is the fully closed position. Therefore, the rotational range of the input member can be automatically changed without operation by the rider.

The movable stopper may be configured to be retracted by a predetermined pressing force applied from the contact portion rotatable integrally with the input member, irrespective of an operation of the movable stopper drive unit.

In such a construction, even when the movable stopper drive unit does not correctly retract the movable stopper because of failure, etc., the rider rotates the input member by hand operation with a predetermined force or more so that the contact portion applies the predetermined pressing force to the movable stopper to retract the movable stopper.

The throttle valve controller may further comprise an opening degree restricting stopper configured to restrict a relative angle range of the output member with respect to the input member to restrict opening and closing ranges of the throttle valve driven by the actuator.

In such a construction, even when the actuator does not correctly operate and the output member is going to rotate in a large amount, the opening degree restricting stopper restricts the relative angle range of the output member with respect to the input member. As a result, abnormal rotation of the throttle valve can be inhibited.

The throttle body may include a plurality of tubular air-intake portions and the actuator may be disposed between adjacent tubular air-intake portions of the plurality of the tubular air-intake portions.

In such a construction, since the actuator is disposed between the adjacent tubular air-intake portions, it does not protrude greatly from the throttle body.

The actuator may have a drive shaft configured to transmit a rotational force to the output member through a worm gear.

In such a construction, since the worm gear is disposed between the drive shaft of the actuator and the output member, the rotational force generated by the rider's hand operation is not transmitted toward the actuator, enabling the rotational force to be surely transmitted to the output member.

The power transmission device may include a rotatable frame that is rotatable in association with the input member; a swing shaft that is rotatably mounted inside the rotatable frame to extend in a direction perpendicular to a rotational axis of the rotatable frame; a relay bevel gear mounted on the swing shaft; and an output bevel gear that is mounted on the output member and is configured to mesh with the relay bevel gear; and the worm gear may be disposed between the drive shaft of the actuator and the swing shaft.

In such a construction, since the worm gear is disposed between the drive shaft of the actuator and the swing shaft, the rotational force generated by the rider's hand operation to rotate the rotatable frame and swing the swing shaft is not transmitted toward the actuator, enabling the rotational force to be surely transmitted from the relay bevel gear to the output bevel gear.

According to another aspect of the present invention, there is provided an engine comprising a throttle valve controller configured to control opening and closing of a throttle valve disposed in an air-intake passage of a throttle body coupled to the engine, the throttle valve controller including an input member that is rotatable in association with a rider's hand operation; a power transmission device with an input part thereof coupled to the input member; an output member that is coupled to an output part of the power transmission device and causes the throttle valve to rotate in association therewith; an actuator configured to drive the power transmission device to cause the output member to rotate relative to the input member to change a rotational ratio of the output member to the input member independently of the hand operation; and a movable stopper configured to change and restrict a rotational range of the input member in closing direction of the throttle valve.

In such a construction, even when a failure occurs in the actuator of the throttle valve controller, the engine is able to maintain a correct operating state by the rider's hand operation, by changing the rotational range of the input member in the closing direction of the throttle valve.

The above and further objects and features of the invention will more fully be apparent from the following detailed description with accompanying drawings.

DETAILED DESCRIPTION OF THE PREFERRED EMBODIMENTS

Hereinafter, embodiments of a throttle valve controller and an engine of the present invention will be described with reference to the accompanying drawings. Herein, directions are generally referenced from the perspective of a rider mounting a motorcycle of FIG. 1.

Embodiment 1

Figure 1:
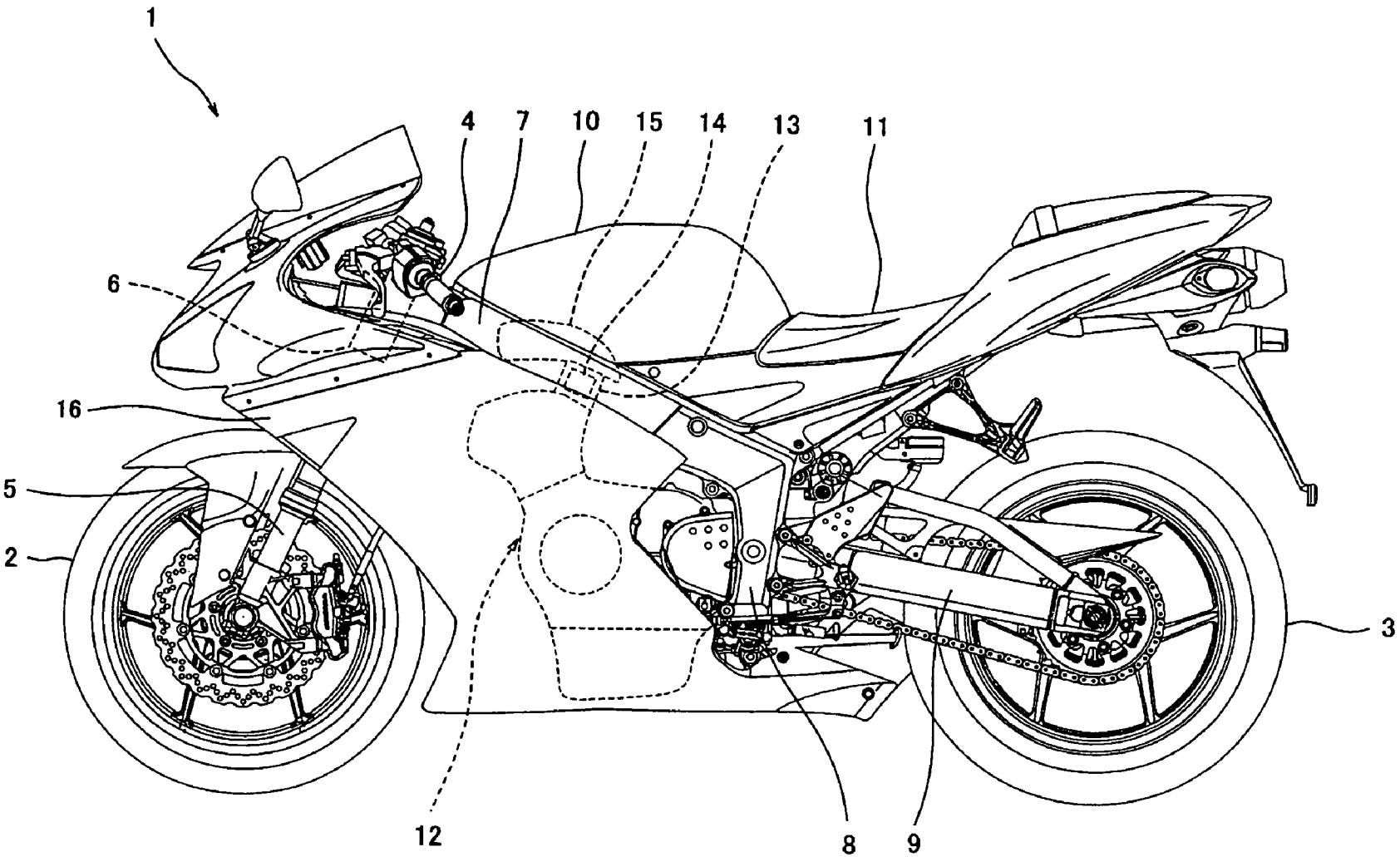
FIG. 1 is a side view of a motorcycle equipped with a throttle valve controller according to a first embodiment of the present invention.

FIG. 1 is a side view of a motorcycle 1 equipped with a throttle valve controller 14 according to a first embodiment of the present invention. The motorcycle 1 is a road sport type motorcycle in which a rider (not shown) rides with an upper body leaning forward. Turning now to FIG. 1, the motorcycle 1 includes a front wheel 2 and a rear wheel 3. The front wheel 2 is rotatably mounted to a lower end portion of a front fork 5 extending substantially vertically. The front fork 5 is mounted on a steering shaft (not shown) by an upper bracket (not shown) attached to an upper end thereof, and an under bracket located below the upper bracket. The steering shaft is rotatably supported by a head pipe 6. A bar-type steering handle 4 extending in a rightward and leftward direction is attached to the upper bracket. When the rider rotates the steering handle 4 clockwise or counterclockwise, the front wheel 2 is turned to a desired direction around the steering shaft.

A pair of right and left main frames 7 extend rearward from the head pipe 6 to be tilted slightly downward. A pair of right and left pivot frames 8 are coupled to rear regions of the main frames 7. A swing arm 9 is pivotally mounted at a front end portion thereof to each pivot frame 8. The rear wheel 3, which is a drive wheel, is rotatably mounted to a rear end portion of the swing arm 9. A fuel tank 10 is disposed behind the steering handle 4. A straddle-type seat 11 is disposed behind the fuel tank 10.

An inline four-cylinder engine 12 is mounted on the main frames 7 and the pivot frames 8 between the front wheel 2 and the rear wheel 3. A throttle device 13 is disposed inside the main frames 7 and is coupled to an intake port of the engine 12. A throttle valve controller 14 is coupled to the throttle device 13 and is configured to control opening and closing of a throttle valve 22 (see FIG. 2) described later. An air cleaner box 15 is disposed below the fuel tank 10 and is coupled to an upstream portion of the throttle device 13 in the flow direction of air taken in from outside and supplied to the engine E. The air cleaner box 15 is configured to take in air from outside by utilizing oncoming wind (ram pressure) from the forward direction during vehicle travel. A cowling 16 is mounted to extend from a front portion of the vehicle body to side portions of the vehicle body so as to cover the engine 12, etc.

Figure 2:
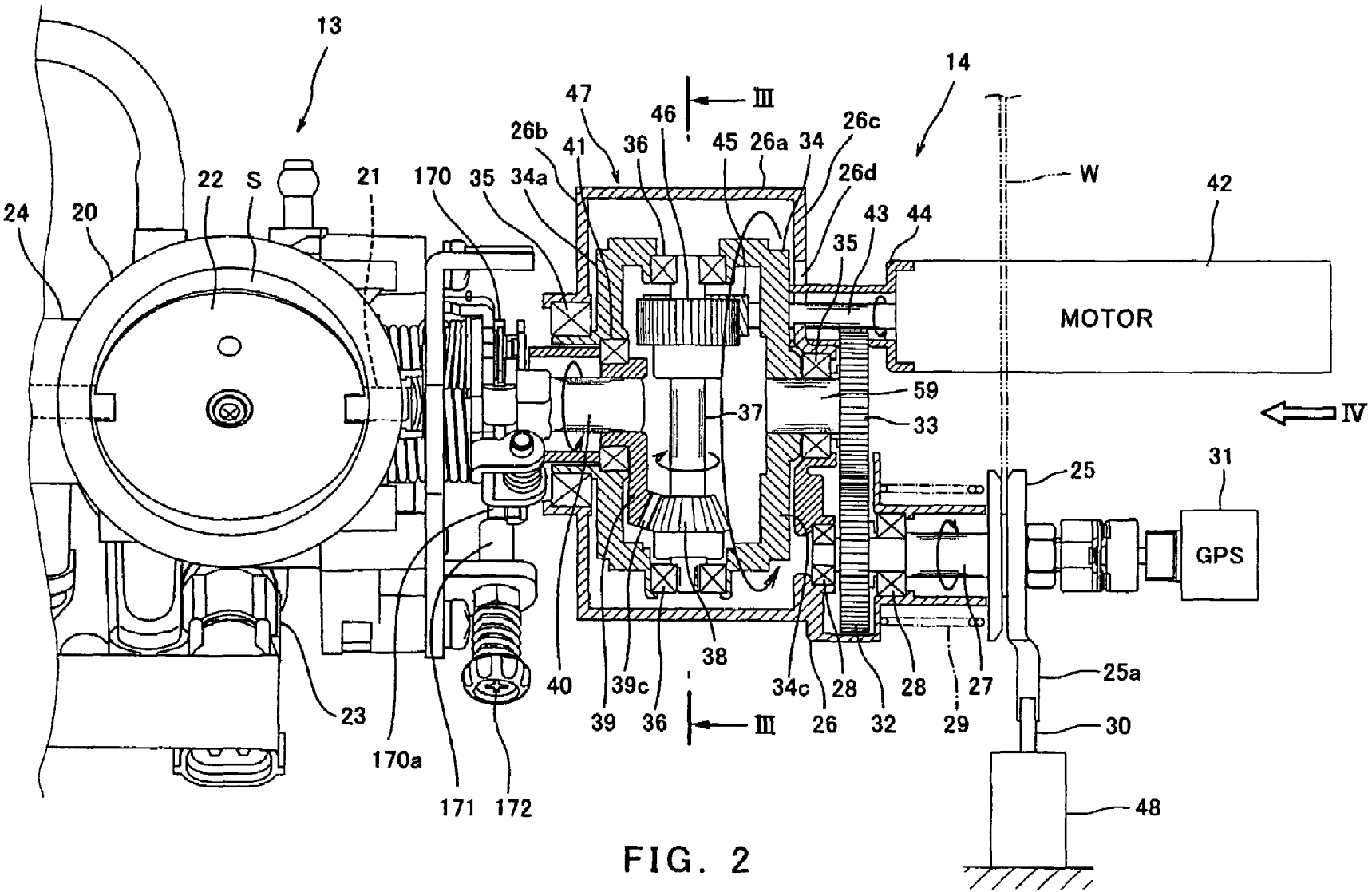
FIG. 2 is a partial cross-sectional view showing a state where the throttle valve controller is coupled to a throttle device equipped in the motorcycle of FIG. 1.

FIG. 2 is a partial cross-sectional view showing a state where the throttle valve controller 14 is coupled to the throttle device 13 of the engine 12 equipped in the motorcycle 1 of FIG. 1. As shown in FIG. 2, the throttle device 13 includes a throttle body 24 having a plurality of tubular air-intake portions 20 arranged in a line (only one tubular air-intake portion 20 is illustrated in FIG. 2). An upstream opening of each tubular air-intake portion 20 is coupled to the air cleaner box 15 (FIG. 1) and a downstream opening thereof is coupled to an intake port of the engine 12 (FIG. 1). A throttle shaft 21 is rotatably disposed to penetrate the tubular air-intake portion 20. A disc-shaped throttle valve 22 is mounted on the throttle shaft 21 and is disposed in an air-intake passage S inside each tubular air-intake portion 20. A fuel injector 23 is attached on an outer wall of each tubular air-intake portion 20 and is configured to suitably inject fuel into the air-intake passage S.

The throttle valve controller 14 is coupled to an end portion of the throttle shaft 21 of the throttle device 13. The throttle valve controller 14 has a fixed case 26 formed by closing openings of a cylindrical portion 26*a* by side wall portions 26*b* and 26*c*. An input shaft (input member) 27 is rotatably mounted to the fixed case 26 by a bearing 28. The input shaft 27 extends substantially in parallel with the throttle shaft 21. A throttle pulley 25 is fixedly mounted on the input shaft 27. A throttle wire W is connected to the throttle pulley 25 so as to operate in association with rotation of a throttle grip of the steering handle 4 (FIG. 1). Upon the rider's hand operation of the throttle grip, the throttle pulley 25 and the input shaft 27 rotate to open and close the throttle valve 22. A return spring 29 is mounted on the fixed case 26 to apply a force to the throttle pulley 25. Under the state where the power generated by the rider's hand operation is not transmitted through the throttle wire W, the throttle pulley 25 is returned to close the throttle valve 22. A grip position sensor (hand-operation angle sensor) 31 is coupled to the throttle pulley 25 and is configured to be able to detect a rotational angle of the input shaft 27 rotatable integrally with the throttle pulley 25.

An input part of a power transmission device 47 is coupled to the input shaft 27. An output shaft (output member) 40 is spline-coupled to the throttle shaft 21 and is coupled to an output part of the power transmission device 47. A rotatable element 170 having a protruding portion 170*a* protruding radially outward is fixedly mounted on the output shaft 40. An idle stopper 171 is mounted on the throttle body 24 to be opposite to the protruding portion 170*a* of the rotatable element 170. The idle stopper 171 is configured to be extensible or protrusible and retractable by an adjustable screw 172 attached to a rear end thereof.

The power transmission device 47 has a second spur gear 33 configured to mesh with a first spur gear 32 externally fittingly mounted on the input shaft 27. The second spur gear 33 is mounted on a coupling shaft 59 coaxial with the output shaft 40. The coupling shaft 59 is rotatably mounted to the fixed case 26 by the bearing 35.

A rotatable frame 34 is disposed in an inner space of the fixed case 26 and is mounted to the coupling shaft 59. A swing shaft 37 is disposed inside the rotatable frame 34 by a bearing 36 so as to extend in a direction perpendicular to a rotational axis of the output shaft 40. A relay bevel gear 38 is externally fittingly mounted on one end portion (lower portion in FIG. 2) of the swing shaft 37. A substantially sector-shaped output bevel gear 39 is mounted on the output shaft 40 and is rotatably mounted on the rotatable frame 34 by a bearing 41. The output bevel gear 39 is in mesh with the relay bevel gear 38.

Figure 3:
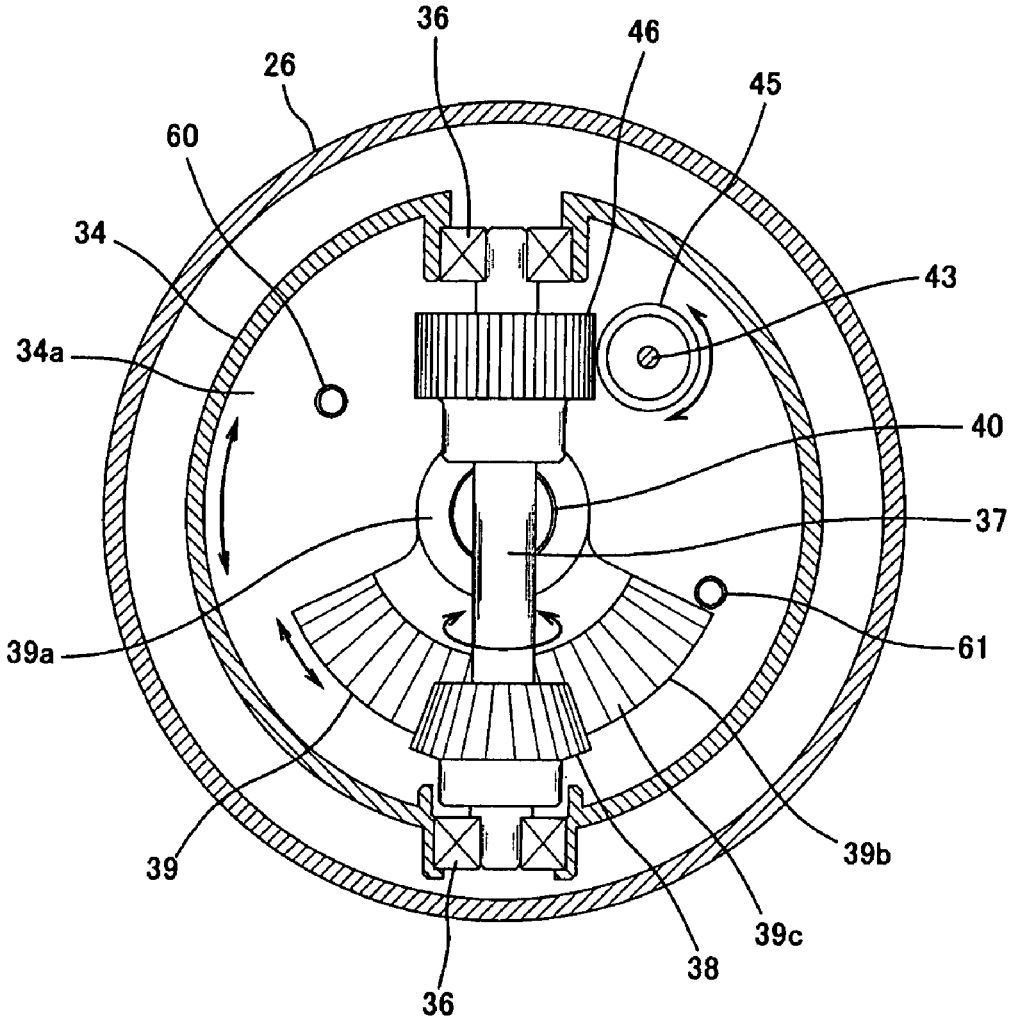
FIG. 3 is a cross-sectional view taken substantially along line III-III of FIG. 2.

FIG. 3 is a partial cross-sectional view taken substantially along line III-III of FIG. 2. As shown in FIG. 3, the output bevel gear 39 includes an annular portion 39*a* fittingly mounted to the output shaft 40 and a sector-shaped portion 39*b* radially protruding from a part of an outer peripheral surface of the annular portion 39*a* toward the relay spur gear 38. The sector-shaped portion 39*b* extends substantially in parallel with an axial direction of the swing shaft 37 and is of a sector-plate shape substantially conforming in shape to a side wall portion 34*a* of the rotatable frame 34. The sector-shaped portion 39*b* is provided with a gear portion 39*c* at an outer peripheral region that is opposite to the relay bevel gear 38 and is configured to contact the relay bevel gear 38.

A pair of opening degree restricting stoppers 60 and 61 protrude from desired locations of the side wall portion 34*a* that is opposite to the sector-shaped portion 39*b* and are configured to contact the sector-shaped portion 39*b*. The restricting stopper 60 restricts a rotational angle of the output bevel gear 39 rotating clockwise in FIG. 3. The restricting stopper 61 restricts a rotational angle of the output bevel gear 39 rotating counterclockwise in FIG. 3. To be specific, the output bevel gear 39 operative in association with the output shaft 40 is restricted by the opening degree restricting stoppers 60 and 61 of the rotatable frame 34 operative in association with the input shaft 27. Thereby, a relative angle range of the output shaft 40 with respect to the input shaft 27 is restricted to a predetermined range, and thus the opening or closing degree of the throttle valve 22 that is driven by a motor 42 described later (FIG. 2) is restricted.

Figure 4:
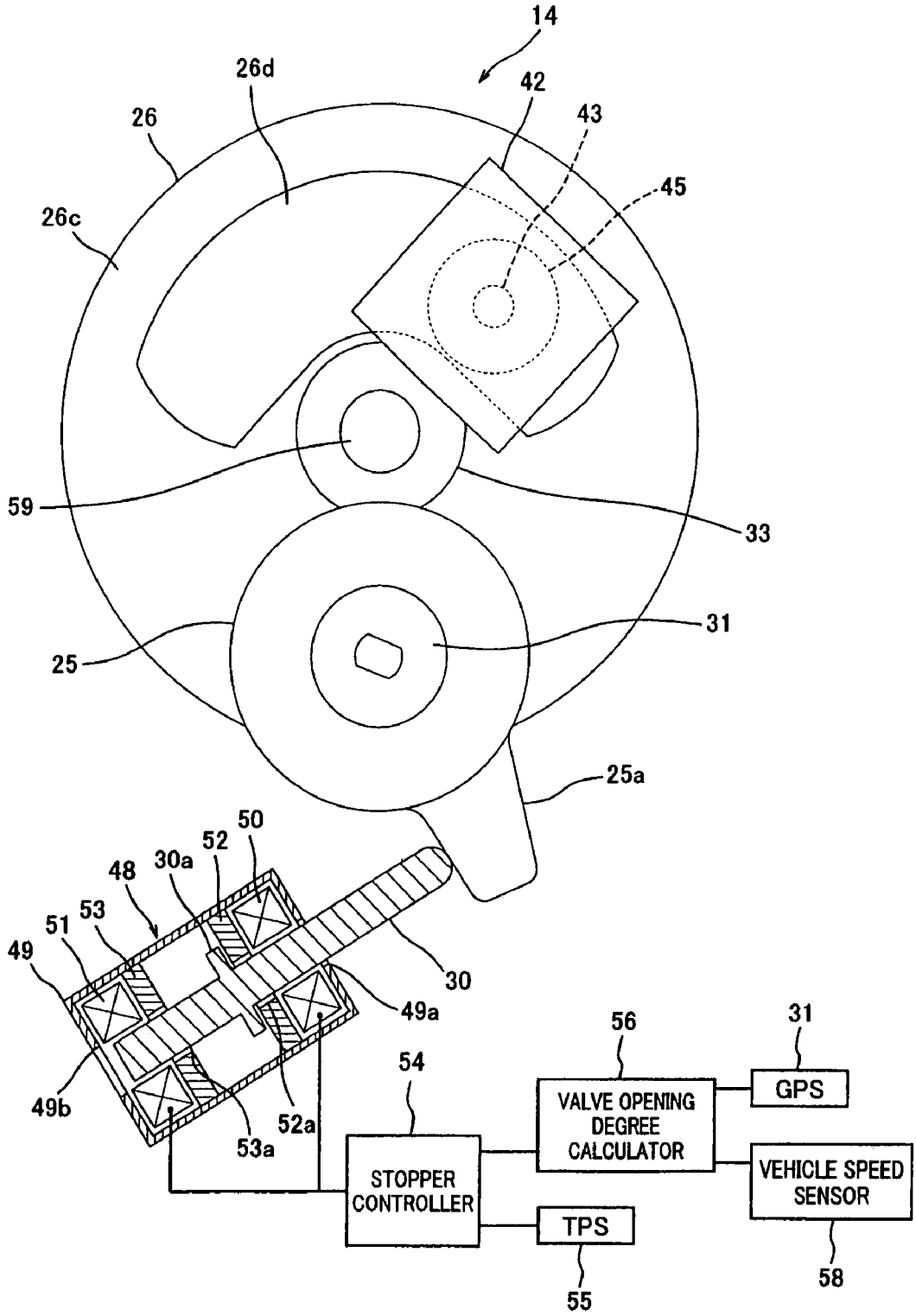
FIG. 4 is a side view of the throttle valve controller as viewed in the direction of IV of FIG. 2.

FIG. 4 is a side view of the throttle valve controller 14 as viewed in the direction of IV of FIG. 2. As shown in FIGS. 2 and 4, the throttle valve controller 14 includes a motor (actuator) 42 having a drive shaft 43 extending in the direction substantially perpendicular to the swing shaft 37. The motor 42 is mounted to a tubular bracket 44 attached to the rotatable frame 34. The bracket 44 is inserted into a circular-arc shaped guide hole 26*d* that opens in the side wall portion 26*c* of the fixed case 26 on the throttle pulley 25 side. As shown in FIG. 2, the drive shaft 43 of the motor 42 rotatably extends from an inner space of the bracket 44 to the interior of the rotatable frame 34 through an opening (not shown) of the rotatable frame 34. A worm 45 is mounted on a tip end of the drive shaft 43 inside the rotatable frame 34. A worm wheel 46 is mounted on the swing shaft 37 and is configured to mesh with the worm 45 (see FIG. 3). When the drive shaft 43 of the motor 42 rotates, the rotation is transmitted through a worm gear including the worm 45 and the worm wheel 46 to the swing shaft 37, which thereby rotates around its axis.

As shown in FIG. 4, the throttle pulley 25 has a contact portion 25*a* protruding radially, which is pushed against the movable stopper 30 at a desired angle, restricting a rotational range of the throttle pulley 25 in the closing direction of the throttle valve 22. The movable stopper 30 is formed of a rod-shaped magnetic member. A solenoid movable stopper drive unit 48 causes the movable stopper 30 to be retractable in the closing direction of the throttle valve 22 on a rotational track of the contact portion 25*a*.

The movable stopper drive unit 48 includes a housing 49 and annular separating plates 52 and 53 that separate an inner space of the housing 49 into three spaces arranged axially. Penetrating holes 49*a* and 49*b* are formed on the housing 49, and penetrating holes 52*a* and 53*a* are formed on the annular separating plates 52 and 53, respectively. The movable stopper 30 is inserted into the penetrating holes 49*a*, 49*b*, 52*a*, and 53*a*. A flange portion 30*a* protrudes outward from an outer peripheral surface of the movable stopper 30 between the two annular separating plates 52 and 53. An electromagnetic coil 50 is disposed in a front space that is closer to a front end of the drive unit 48 than the annular separating plate 52 on the front end side (right side in FIG. 4). An electromagnetic coil 51 is disposed in a rear space that is closer to the rear end of the drive unit 48 than the annular separating plate 53 on the rear end side (left side in FIG. 4).

A stopper controller device 54 controls the direction in which current is flowed through the electromagnetic coils 50 and 51 to enable the movable stopper drive unit 48 to extend and retract the movable stopper 30. The stopper controller 54 receives signals from a valve opening degree calculator 56 that determines the opening degree of the throttle valve 22 and from a throttle position sensor (valve angle sensor) 55 that detects an actual rotational angle of the throttle valve 22. The valve opening degree calculator 56 is configured to calculate and determine a suitable opening degree of the throttle valve 22 based on a detected value from the grip position sensor 31, a driving state of the motorcycle 1 which is detected by a vehicle speed sensor 58, etc.

Subsequently, an operation of the throttle valve controller 14 will be described. As shown in FIG. 2, upon the rider's hand operation to rotate the throttle grip of the steering handle 4 (FIG. 1), the rotation is transmitted through the wire W to the throttle pulley 25, which thereby rotates. Thereby, the input shaft 27 rotates in the corresponding direction. According to the rotation of the input shaft 27, the first spur gear 32 rotates the second spur gear 33 in association therewith, causing the rotatable frame 34 coupled to the second spur gear 33 via the coupling shaft 59 to rotate. As shown in FIG. 3, according to the rotation of the rotatable frame 34, the swing shaft 37 swings along the sector-shaped output bevel gear 39. In this case, the worm wheel 46 of the swing shaft 37 engages with the worm 45 coupled to the motor 42 so as to inhibit the rotation of the swing shaft 37 and does not rotate around the swing shaft 37, so that the swing shaft 37 does not rotate around its axis. Since the swing shaft 37 swings with the relay bevel gear 38 unrotated, the sector-shaped output bevel gear 39 in mesh with the relay bevel gear 38 rotates. Thereby, the output shaft 40 and the throttle shaft 21 rotate, causing the throttle valve 22 to be opened and closed.

As shown in FIGS. 2 to 4, if the valve opening degree calculator 56 determines depending on the traveling state of the motorcycle 1 that the opening degree of the throttle valve 22 is required to be set to a value different from that in response to the rider's hand-operation, the motor 42 is driven. To be specific, when the worm 45 is driven by the motor 42, the worm wheel 46 in mesh with the worm 45 rotates, causing the swing shaft 37 to rotate around its axis. Thereby, the relay bevel gear 38 rotates and the output bevel gear 39 rotates in association therewith, causing the output shaft 40 and the throttle shaft 21 to rotate, so that the throttle valve 22 is opened and closed. In other words, the motor 42 causes the output shaft 40 to rotate relative to the input shaft 27 to change a rotational ratio of the output shaft 40 to the input shaft 27 independently of the rider's hand operation, enabling control to automatically open and close the throttle valve 22 so that the opening degree of the throttle valve 22 becomes larger or smaller than that resulting only from the rider's hand operation.

If the motor 42 does not correctly operate and unexpectedly stops under the state where the motor 42 is operating to cause the throttle valve 22 to be opened to an opening degree larger than that resulting only from the rider's hand operation, the throttle valve 22 will be left open by the excess phase angle in the opening direction of the throttle valve 22 due to the stopping of the motor 42. In this state, even if the rider attempts to return the throttle grip to a position corresponding to a fully closed position of the throttle valve 22, the throttle valve 22 is opened by the excess phase angle and thus is unable to return to an opening degree corresponding to an idling engine speed in the normal state. Accordingly, as described below, the movable stopper 30 is configured to be retracted to increase a rotational range of the throttle pulley 25 in the closing direction of the throttle valve 22.

Figure 5A:
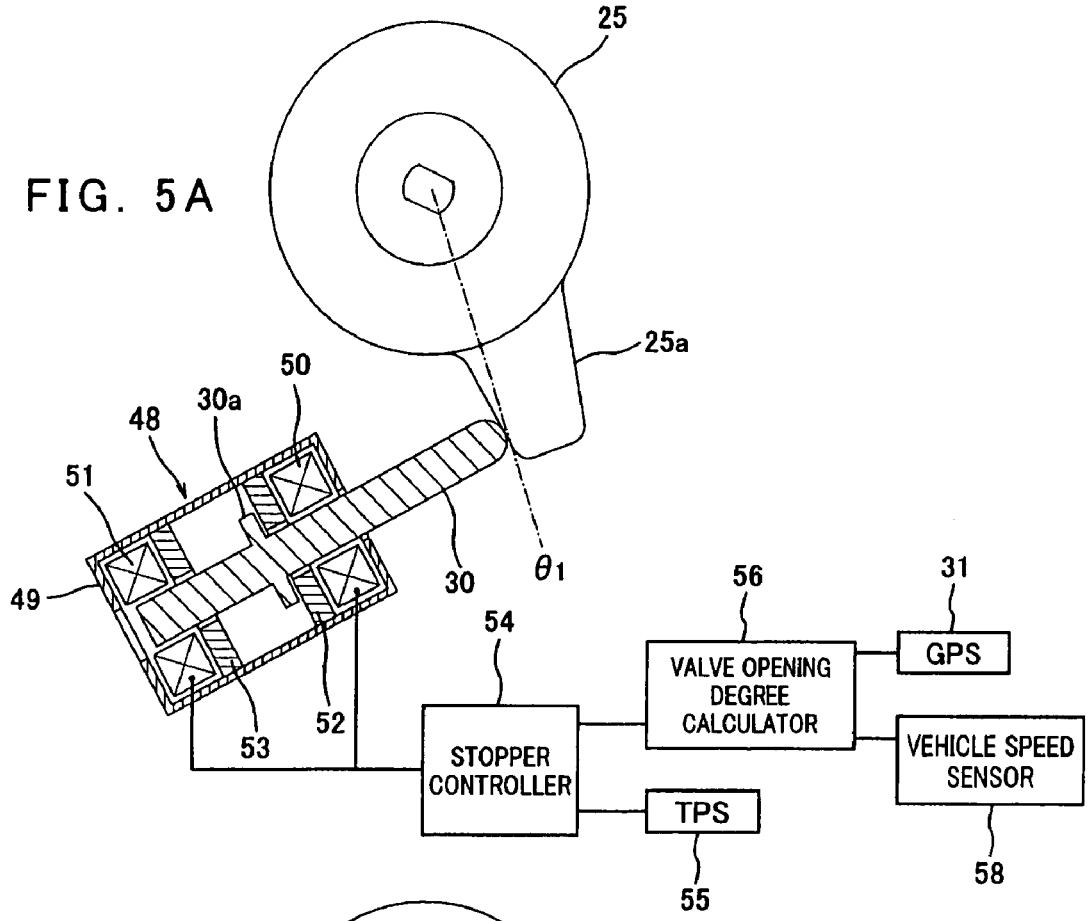
FIG. 5A is a cross-sectional view showing an extended state of a movable stopper of the throttle valve controller of FIG. 4.
Figure 5B:
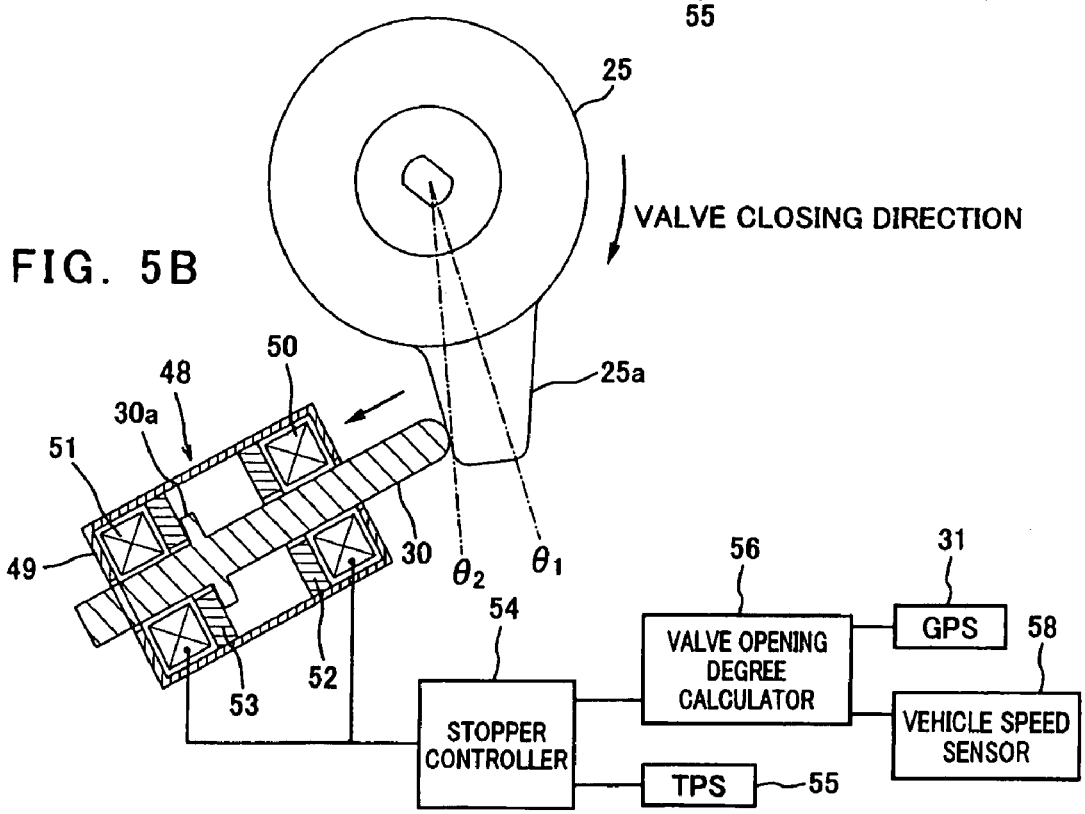
FIG. 5B is a cross-sectional view showing a retracted state of the movable stopper of the throttle valve controller of FIG. 4.

FIG. 5A is a cross-sectional view showing an extended state of the movable stopper 30 of the throttle valve controller 14 of FIG. 4. FIG. 5B is a cross-sectional view showing a retracted state of the movable stopper 30. As shown in FIG. 5A, if the throttle position sensor 55 detects that the throttle valve 22 is opened to a predetermined angle or larger despite the fact that the target opening degree of the throttle valve 22 that is calculated by the valve opening degree calculator 56 is the fully closed position, the stopper controller 54 causes the movable stopper drive unit 48 to retract the movable stopper 30 as shown in FIG. 5B. For example, when it is detected that there is a deviation (excess phase angle) of 2 to 3 degrees between the target opening degree (fully closed position) and the actual opening degree of the throttle valve 22, the stopper controller 54 continues to retract the movable stopper 30 for several milliseconds. In this case, since the movable stopper 30 is retracted on the rotational track of the contact portion 25*a* of the throttle pulley 25, the rider is able to further rotate the throttle grip in the closing direction of the throttle valve 22 from a normal fully closed position and stop the throttle grip.

In the above construction shown in FIGS. 1 to 5B, even when the motor 42 does not correctly operate and the throttle valve 22 will be left open by the excess phase angle in the opening direction of the throttle valve 22, the excess phase angle can be reduced by the rider's hand operation. By retracting the movable stopper 30 sufficiently in a displacement amount with respect to the excess phase angle of the throttle valve 22, the protruding portion 170*a* of the rotatable element 170 contacts the idle stopper 171 to return the throttle valve 22 to the idling opening degree. Since the movable stopper 30 is retracted on the rotational track of the contact portion 25*a*, the rotational range of the throttle pulley 25 in the closing direction of the throttle valve 22 can be changed to a suitable range. Since the movable stopper 30 is electrically moved to be retracted by the movable stopper drive unit 48, the rotational range of the throttle pulley 25 can be automatically changed without special operation performed by the rider. Furthermore, even if the motor 42 does not correctly drive and thereby the output shaft 40 is going to rotate in a large amount, the opening degree restricting stoppers 60 and 61 restrict a relative angle range of the output bevel gear 39 with respect to the input shaft 27. As a result, abnormal rotation of the throttle valve 22 can be inhibited.

Alternative Example 1

Figure 6A:
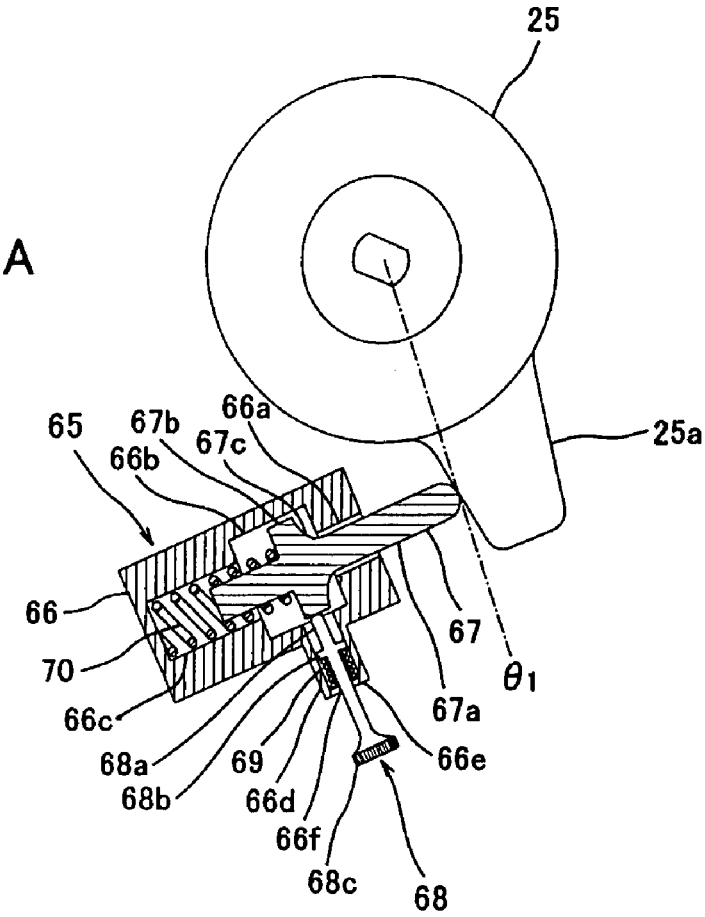
FIG. 6A is a cross-sectional view showing an extended state of a movable stopper according to a first alternative example of the first embodiment.
Figure 6B:
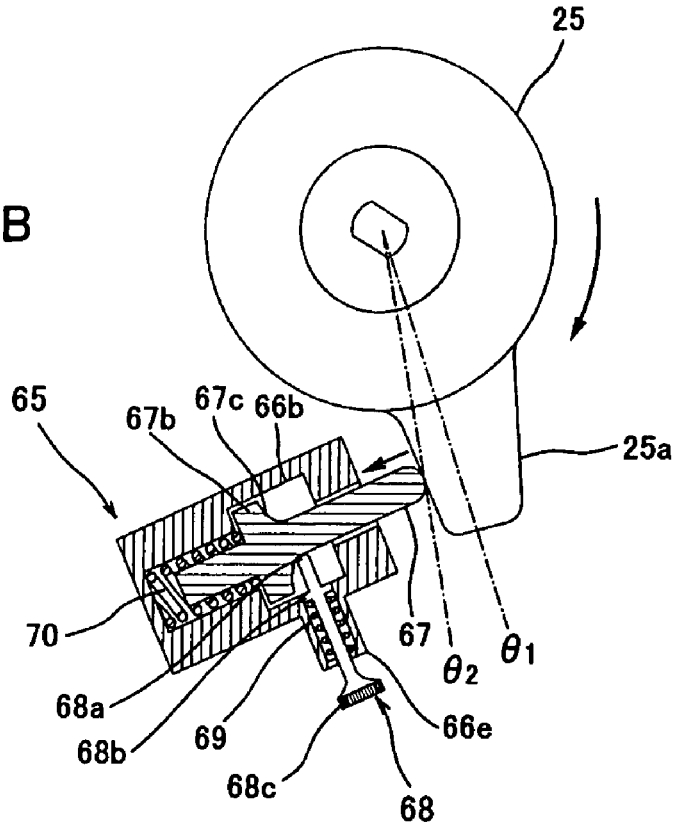
FIG. 6B is a cross-sectional view showing a retracted state of the movable stopper according to the first alternative example.

Subsequently, a first alternative example of a movable stopper applicable to the throttle valve controller 14 of the first embodiment will be described. FIG. 6A is a cross-sectional view showing an extended state of a movable stopper 65 according to the first alternative example of the first embodiment. FIG. 6B is a cross-sectional view showing a retracted state of the movable stopper 65 according to the first alternative example. As shown in FIG. 6A, the movable stopper 65 has a housing 66 fixed at a predetermined location, into which a rear portion of a stopper portion 67 is inserted. The housing 66 has a penetrating hole 66*a* that opens toward the contact portion 25*a* of the throttle pulley 25, a large-diameter portion 66*b* which is a space having a diameter larger than that of the penetrating hole 66*a*, and a small-diameter concave portion 66*c* that is coaxial with the penetrating hole 66*a* and has a diameter smaller than that of the large-diameter portion 66*b*. The housing 66 further has a bottomed cylindrical protruding portion 66*d* provided to extend in the direction perpendicular to the axial direction of the stopper portion 67 and has a space connected to the large-diameter portion 66*b*. The stopper portion 67 has a cylindrical portion 67*a* inserted into the penetrating hole 66*a* and a flange portion 67*b* that is located in the large-diameter portion 66*b* and protrudes radially outward from an outer peripheral surface of the cylindrical portion 67*a*. The flange portion 67*b* has a tapered surface 67*c* having a width decreasing toward the contact portion 25*a*.

A spring 70 is mounted in the small-diameter concave portion 66*c* of the housing 66 and is configured to apply a force to cause the flange portion 67*b* of the stopper portion 67 to move toward the contact portion 25*a*. A piston 68 is inserted into a small hole 66*f* formed on an outer end surface 66*e* of the protruding portion 66*d*. The piston 68 has at a tip end thereof a stop portion 68*a* configured to contact the outer peripheral surface of the flange portion 67*b* with the stopper portion 67 extended toward the contact portion 25*a*. The piston 68 has a spring receiver portion 68*b* configured to receive the spring 69 that applies a force to move the piston 68 toward the large-diameter portion 66. The piston 68 has a release portion (return member) 68*c* at a rear end thereof which is held when the piston 68 is pulled out against the force applied by the spring 69.

Subsequently, an operation of the movable stopper 65 will be described. As shown in FIG. 6A, since the stopper portion 67 is maintained in the extended state by the force applied by the spring 70 in the normal state, the throttle pulley 25 is in a first fully closed position in which a phase angle around the throttle pulley 25 at a contact point between the stopper portion 67 and the contact portion 25*b* is θ1. On the other hand, as shown in FIG. 6B, when the rider rotates the throttle grip to close the throttle valve 22 with a predetermined force or more, for example, about 45 kg weight or more in an abnormal state, the contact portion 25*a* of the throttle pulley 25 retracts the stopper portion 67 against the force applied by the spring 70, and throttle pulley 25 is in a second fully closed position in which the phase angle is θ2. For example, a predetermined force required to rotate the throttle grip in the opening direction of the throttle valve 22 is about 2 kilograms. The force to close the throttle valve 22 is desirably set to be 20 to 25 times as large as the force to open the throttle valve 22, but is not intended to be limited to this. According to the retraction of the stopper portion 67, the flange portion 67*b* moves backward within the large-diameter portion 66. Thereby, the piston 68 protrudes into the large-diameter portion 66*b* by the force applied by the spring 69, and the stop portion 68*a* stops the flange portion 67*b*, maintaining the stopper portion 67 in a retracted state. By pulling the release portion 68*c* in the state where the predetermined force is not applied to the stopper portion 67 by the rider, the piston 68 is retracted against the force applied by the spring 69, releasing the flange portion 67*b*. Thus, the stopper portion 67 is reset to be in an extended state.

In the manner described above, even if the motor 42 does not correctly operate and the throttle valve 22 is left open by the excess phase angle due to the stopping of the motor 42, the throttle valve 22 can be forcibly returned to the idle opening degree by the rider's hand-operation to rotate the throttle grip with the predetermined force or more. Since the movable stopper 65 is configured to mechanically stop/release stopper portion 67 in and from the retracted state, it is stably extended and retracted without being affected by electric or software errors.

Alternative Example 2

Figure 7A:
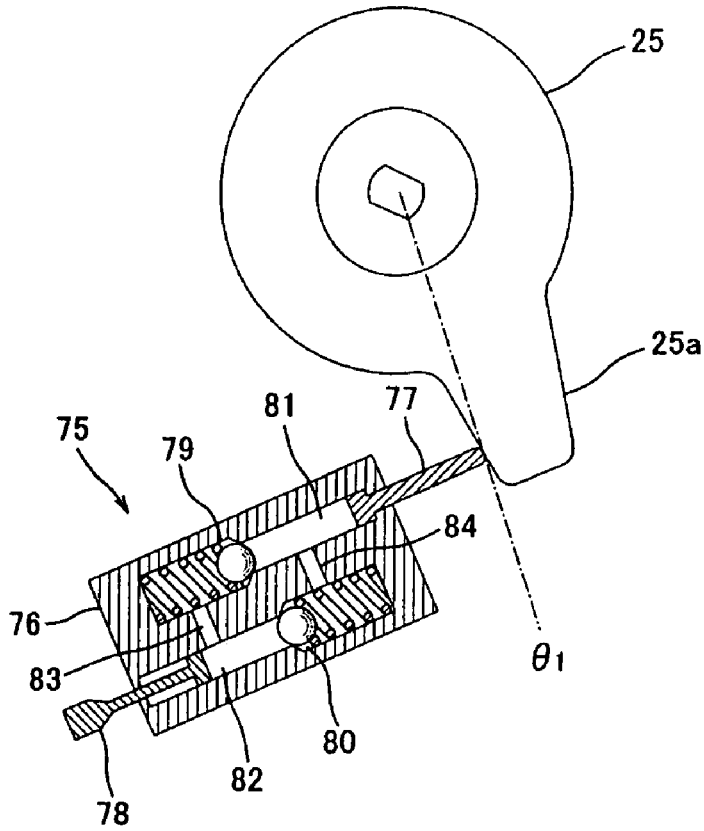
FIG. 7A is a cross-sectional view showing an extended state of a movable stopper according to a second alternative example of the first embodiment.
Figure 7B:
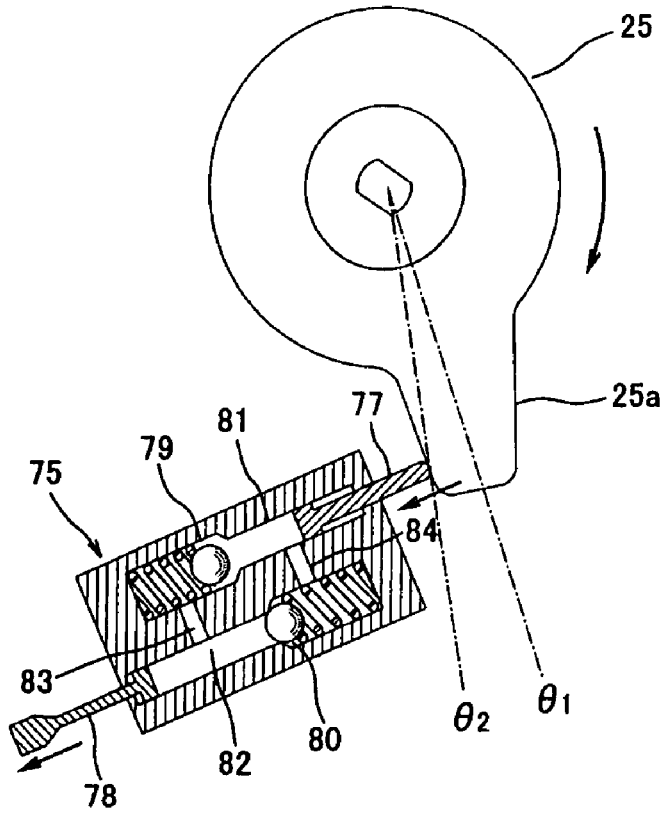
FIG. 7B is a cross-sectional view showing a retracted state of the movable stopper according to the second alternative example.

Subsequently, a second alternative example of a movable stopper applicable to the throttle valve controller 14 of the first embodiment will be described. FIG. 7A is a cross-sectional view showing an extended state of a movable stopper 75 according to the second alternative example of the first embodiment. FIG. 7B is a cross-sectional view showing a retracted state of the movable stopper 75 according to the second alternative example. As shown in FIG. 7A, the movable stopper 75 has a stopper portion 77 movably inserted into a hydraulic cylinder 76. The hydraulic cylinder 76 has a first hydraulic passage 81 into which the stopper portion 77 is inserted, and a second hydraulic passage 82 into which a return piston 78 is inserted. The first hydraulic passage 81 and the second hydraulic passage 82 are connected to each other through a first relief valve 79 and a first communication passage 83. Actuation of the first relief valve 79 causes oil to flow from the first hydraulic passage 81 into the second hydraulic passage 82. A pressing force with a predetermined value or more may be applied to the stopper portion 77 by the contact portion 25*a* of the throttle pulley 25 to actuate the first relief valve 79. Further, the first hydraulic passage 81 and the second hydraulic passage 82 are connected to each other through a second relief valve 80 and a second communication passage 84. The second relief valve 80 causes the oil from the second hydraulic passage 82 to flow into the first hydraulic passage 81 so that the stopper portion 77 is extended by a load generated by pushing in the second return piston 78.

Subsequently, an operation of the movable stopper 75 will be described. As shown in FIG. 7A, in the normal state, the first relief valve 79 is closed, and thus the stopper portion 77 is maintained in an extended state, causing the throttle pulley 25 to be in a fully closed position at a phase angle θ1. On the other hand, as shown in FIG. 7B, when the rider rotates the throttle grip to close the throttle valve 22 with a predetermined force or more, for example, 45 kilograms, the first relief valve 79 is opened by the pressing force of the contact portion 25*a* of the throttle pulley 25 and thus the stopper portion 77 is retracted, causing the throttle pulley 25 to be in a fully closed position at a phase angle θ2. By pushing back the return piston 78 protruding backward according to the retraction of the stopper portion 77, the second relief valve 80 is opened and the stopper portion 77 is extended, causing the throttle pulley 25 to be in the fully closed position at the phase angle θ1.

In the above construction, the movable stopper 75 is configured to hydraulically extend and retract the stopper portion 77 stably, without being negatively affected by electric or software errors and substantially without occurrence of mechanical wear, etc.

Alternative Example 3

Figure 8A:
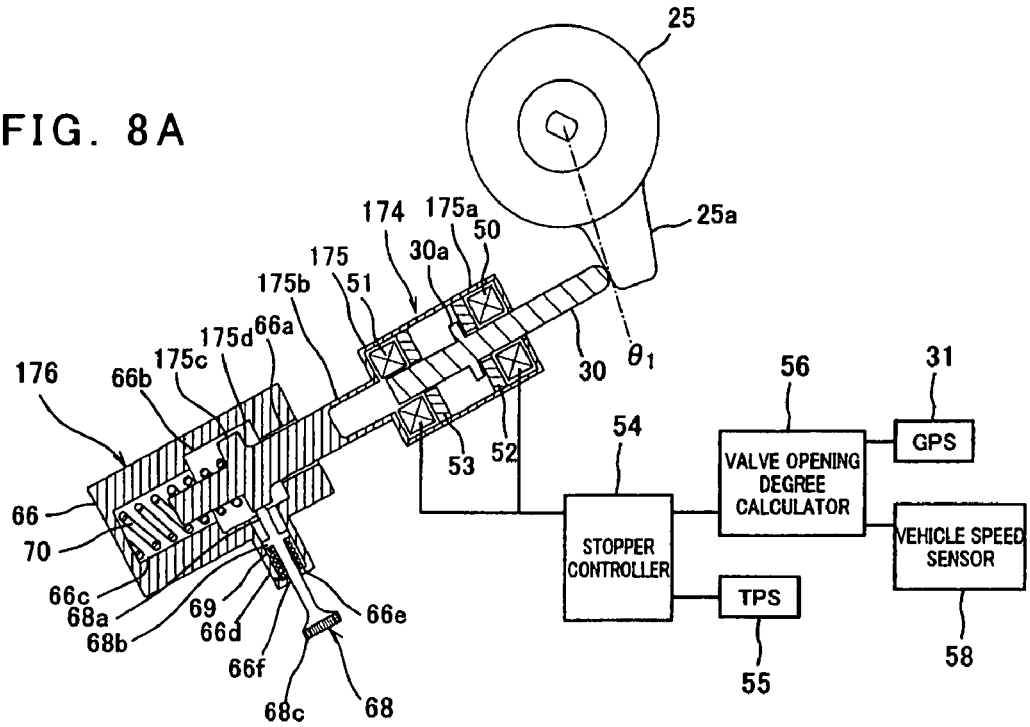
FIG. 8A is a cross-sectional view showing an extended state of a movable stopper according to a third alternative example of the first embodiment.
Figure 8B:
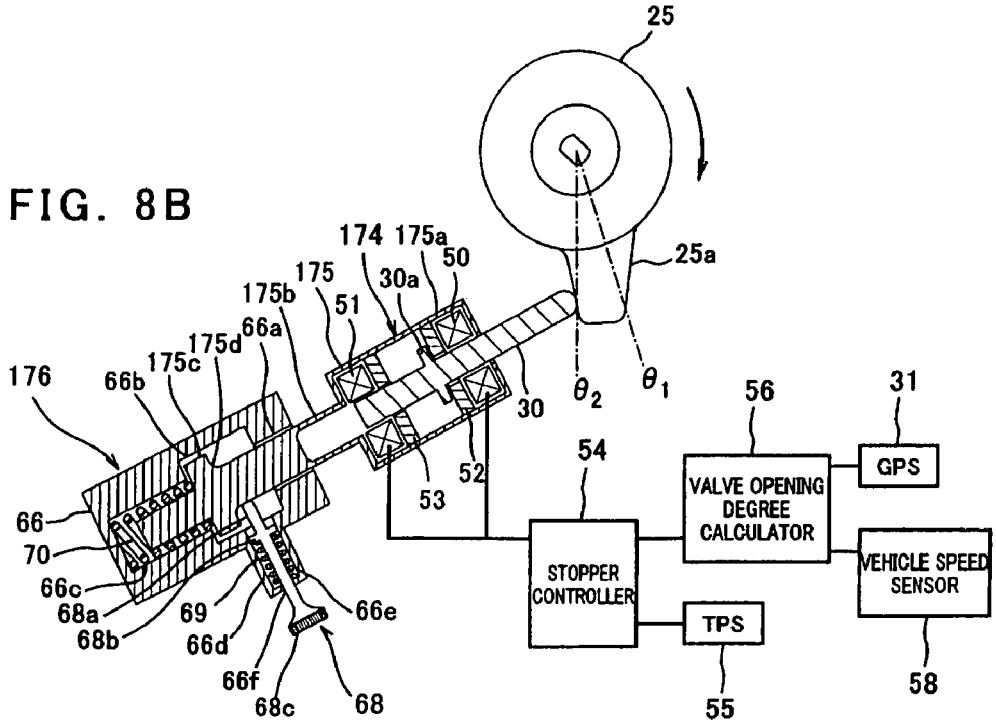
FIG. 8B is a cross-sectional view showing a retracted state of the movable stopper according to the third alternative example.

Subsequently, a third alternative example of a movable stopper applicable to the throttle valve controller 14 of the first embodiment will be described. FIG. 8A is a cross-sectional view showing an extended state of a movable stopper 30 according to the third alternative example of the first embodiment. FIG. 8B is a cross-sectional view showing a retracted state of the movable stopper 30. In the third alternative example, the movable stopper 30 is configured to be extensible and retractable by arranging in series the electromagnetic movable system illustrated in the first embodiment and the mechanical movable system illustrated in the first alternative example.

The movable stopper 30 is driven to be extended and retracted by an electromagnetic movable stopper drive unit 174. The movable stopper drive unit 174 has a construction substantially identical to that of FIG. 5, in which a shaft portion 175*b* protrudes from a rear portion of the housing 175 and is inserted into a housing 66 of a movable unit 176. The movable unit 176 has a construction substantially identical to that of FIG. 6, in which the shaft portion 175*b* has a flange portion 175*c* that is located in the large-diameter portion 66*b* of the housing 66 and protrudes radially outward from the outer peripheral surface of the shaft portion 175*b*. The flange portion 175*c* has a tapered surface 175*d* at a tip end thereof that has a width decreasing toward the contact portion 25*a*. Since the other components are identical to those of the first embodiment and the first alternative example, they are referenced by the same reference numbers and will not be further described herein.

Subsequently, an operation of the movable stopper 30 will be described. As shown in FIG. 8A, in the normal state, the housing 175 of the movable stopper drive unit 174 is maintained in an extended state by the force applied by the spring 70, and the movable stopper 30 is maintained in an extended state by an electromagnetic force applied by the movable stopper drive unit 174. If the movable stopper drive unit 174 does not correctly retract the movable stopper 30 because of the electric or software errors generated in the stopper controller 54, etc., the rider pushes and rotates the throttle grip with a predetermined force or more in the closing direction of the throttle valve 22 to cause the contact portion 25*a* of the throttle pulley 25 to retract the movable stopper 30 together with the housing 175 against the force applied by the spring 70, so that the throttle pulley 25 is further rotated in the closing direction.

As described above, even in the case where the movable stopper drive unit 174 does not correctly retract the movable stopper 30 because of the electric or software errors generated in the stopper controller 54, etc., the rider pushes and rotates the throttle grip in the closing direction of the throttle valve 22 to cause the contact portion 25*a* of the throttle pulley 25 to retract the movable stopper 30 together with the movable stopper drive unit 174 so that the throttle valve 22 can be forcibly returned to the idle opening degree.

Alternative Example 4

Figure 9:
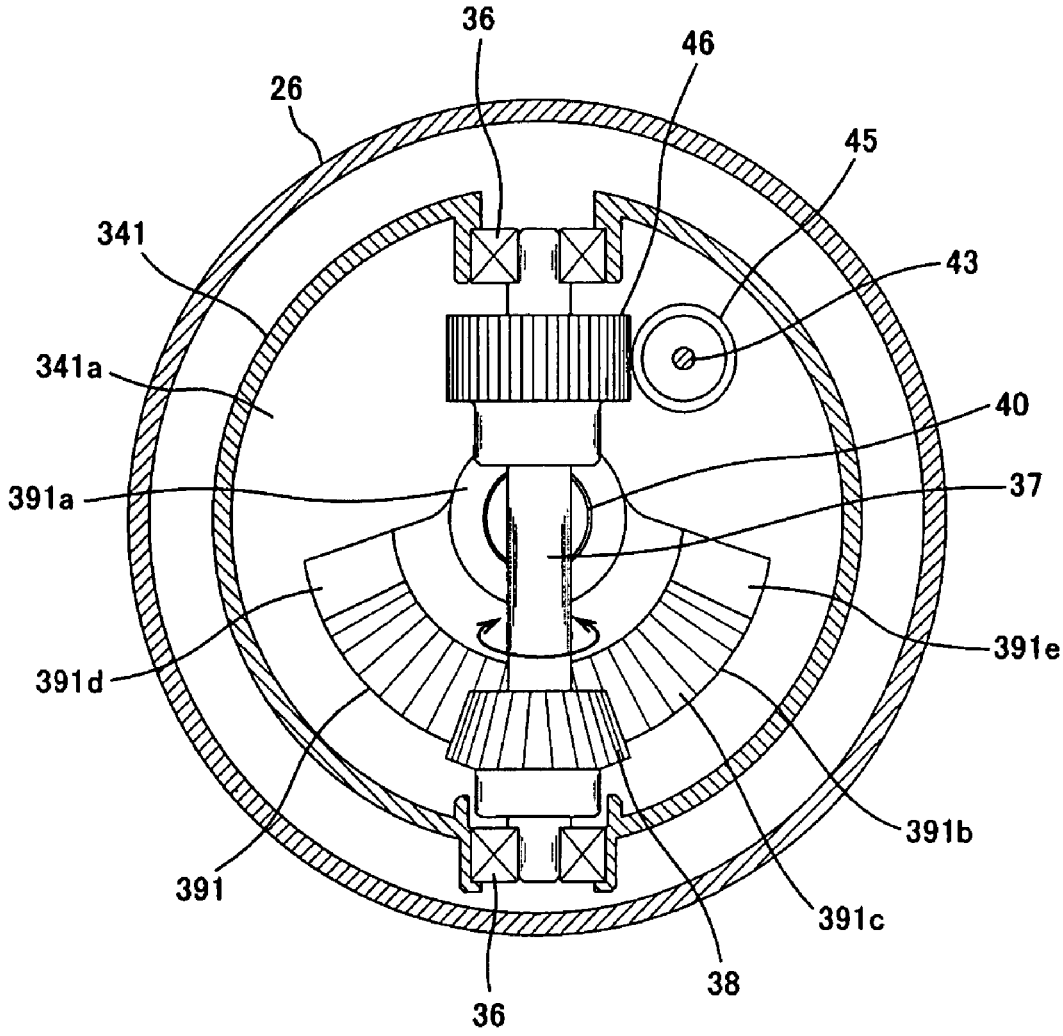
FIG. 9 is a cross-sectional view of an opening degree restricting stopper according to a fourth alternative example of the first embodiment.

Subsequently, a fourth alternative example of an opening degree restricting stopper applicable to the throttle valve controller 14 of the first embodiment will be described. FIG. 9 is a cross-sectional view showing the fourth alternative example of the opening degree restricting stopper. Components which are different from those described in the above embodiment are referenced to by reference numbers obtained by multiplying the corresponding reference numbers by ten and adding one to the resulting members, and the components which are identical to those described in the above embodiment will not be further described herein. As shown in FIG. 9, opening degree restricting stoppers 391*d* and 391*e* of the fourth alternative example are mounted on a sector-shaped output bevel gear 391 instead of on a rotatable frame 341. The output bevel gear 391 includes an annular portion 391*a* fittingly mounted to the output shaft 40 and a sector-shaped portion 391*b* protruding from a part of the outer peripheral surface of the annular portion 391*a* toward the relay bevel gear 38. The sector-shaped portion 391*b* is of a sector-plate shape that extends substantially in parallel with the axial direction of the swing shaft 37 and is opposite to a side wall portion 341*a* of the rotatable frame 341. A gear portion 391*c* is formed on an outer peripheral region of the sector-shaped portion 391*b* that is opposite to and is configured to contact the relay bevel gear 38, except for right and left end portions in a circumferential direction thereof. The right and left end portions of the outer peripheral region of the sector-shaped portion 391*b* have flat surfaces that have a width larger than a tooth pitch of the gear portion 391*c* and are substantially as high as a convex portion of the gear portion 391*c*. The flat surfaces are the opening degree restricting stoppers 391*d* and 391*e*.

In the above construction, even if the output shaft 40 is going to rotate in a large amount due to an abnormality occurring in the motor 42, etc., the relay bevel gear 38 does not move beyond the opening degree restricting stoppers 391*d* and 391*e* of the output bevel gear 391, and a relative angle range of the output bevel gear 391 with respect to the input shaft 27 (FIG. 2) is restricted. This makes it possible to maintain the throttle valve 22 (FIG. 1) in a suitable opening degree range. Instead of forming the flat surfaces at the right and left end portions of the outer peripheral region of the sector-shaped portion 391*b* of the output bevel gear 391, protrusions that are higher than convex portions of the gear portion 391*c* may be provided to serve as the opening degree restricting stopper.

Embodiment 2

Figure 10:
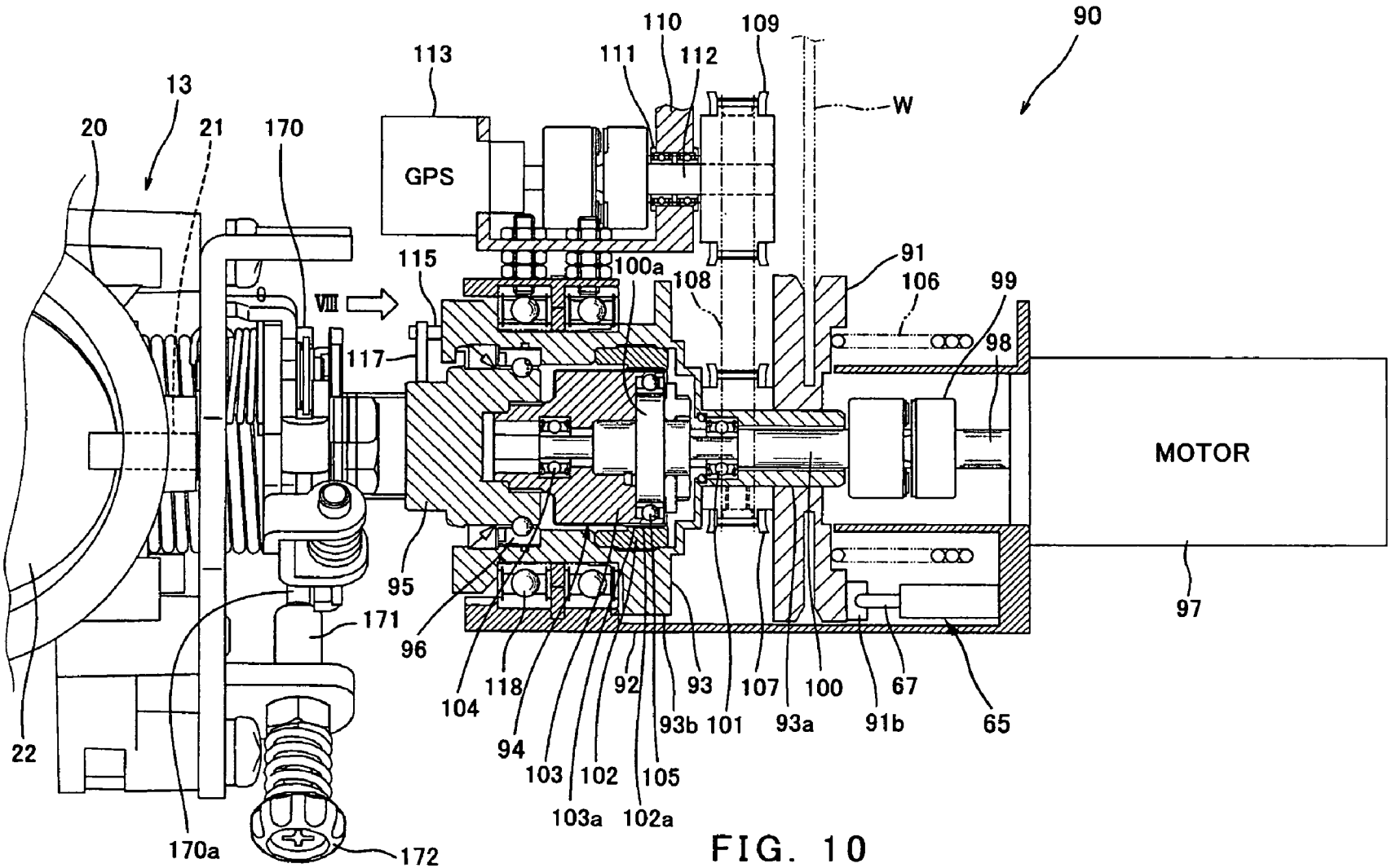
FIG. 10 is a cross-sectional view of a throttle valve controller according to a second embodiment.

FIG. 10 is a cross-sectional view of a throttle valve controller 90 according to a second embodiment. As shown in FIG. 10, the throttle valve controller 90 is coupled to an end portion of the throttle shaft 21 of the throttle device 13. The throttle valve controller 90 has an input member 93 rotatably mounted on the fixed case 92 by a bearing 118. The input member 93 includes a small-diameter cylindrical portion 93*a* coaxial with the throttle shaft 21 and a large-diameter cylindrical portion 93*b* having an outer diameter larger than that of the small-diameter cylindrical portion 93*a*. A throttle pulley 91 is externally fittingly mounted to the outer peripheral surface of the small-diameter cylindrical portion 93*a* of the input member 93. The throttle wire W is connected to the throttle pulley 91 to be operative in association with the rotation of the throttle grip of the steering handle 4 (FIG. 1). Upon the rider hand-operating the throttle grip, the throttle pulley 91 and the input member 93 rotate. A return spring 106 is mounted on the fixed case 92 so as to apply a force to the throttle pulley 91. The throttle pulley 91 is returned in the closing direction of the throttle valve 22 in the state where the force resulting from the rider's hand-operation is not transmitted to the throttle wire W.

A first pulley 107 is externally fittingly mounted to the small-diameter cylindrical portion 93*a* of the input member 93. The rotational force of the first pulley 107 is transmitted to a second pulley 109 through a timing belt 108. The second pulley 109 is coupled to one end of a rotational shaft 112 whose rotational axis extends substantially in parallel with the input member 93. The rotational shaft 112 is rotatably mounted by a bearing 111 on a bracket 110 coupled to the fixed case 92. A grip position sensor (hand-operation angle sensor) 113 is coupled to an opposite end of the rotational shaft 112 and is configured to be able to detect a rotational angle of the input member 93 rotatable integrally with the throttle pulley 91. An input part of a power transmission device 94 is coupled to the input member 93. An output shaft (output member) 95 is coupled to the throttle shaft 21 and is coupled to an output part of the power transmission device 94.

Figure 11A:
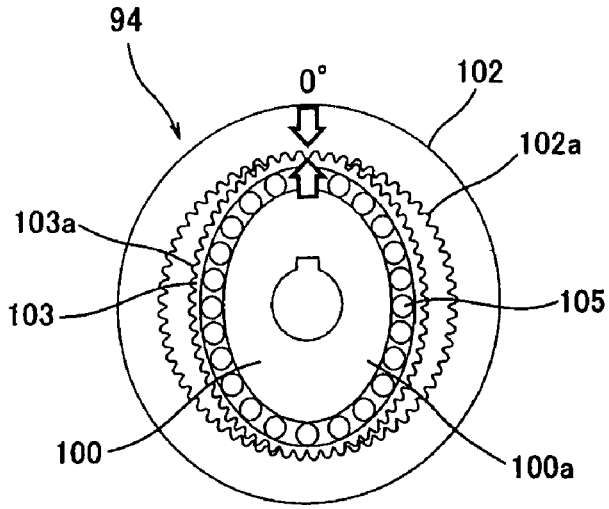
FIGS. 11A to 11C are views of a power transmission system of the throttle valve controller of FIG. 10.
Figure 11B:
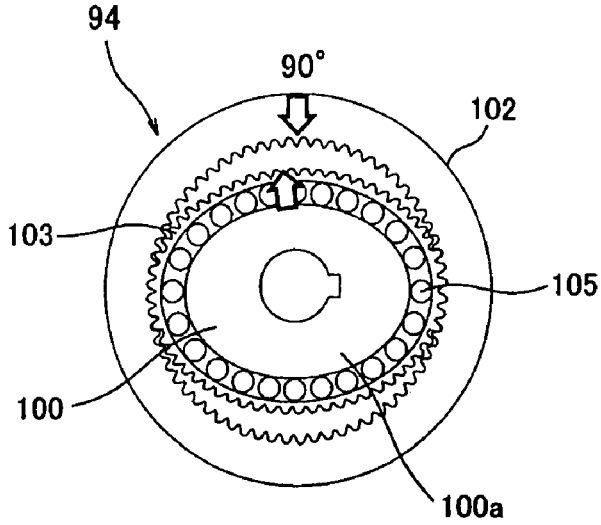
Figure 11C:
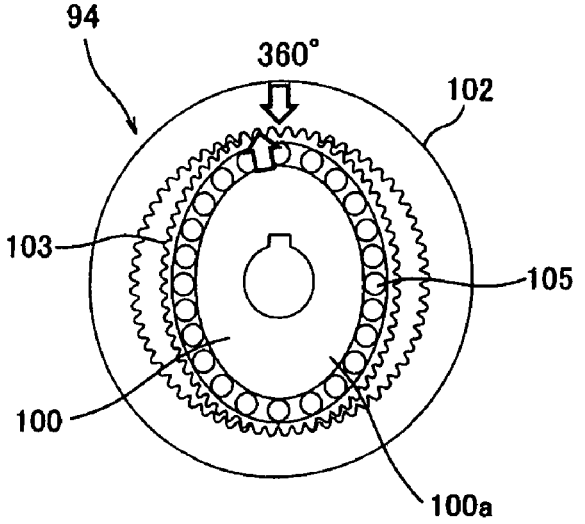

FIGS. 11A to 11C are views showing the operation of the power transmission device 94 of the throttle valve controller 90. As shown in FIGS. 10 and 11A, the power transmission device 94 has a substantially cylindrical circular spline 102 that is fixedly mounted to an inner peripheral surface of the large-diameter cylindrical portion 93*b* and is provided with a gear portion 102*a* on an inner peripheral surface thereof. A flex spline 103 is rotatably mounted on the inner side of the circular spline 102 and is provided on an outer peripheral surface thereof with a gear portion 103*a* configured to mesh with the gear portion 102*a* of the circular spline 102. The flex spline 103 is formed of a metal elastic body of a thinned cup shape. In this embodiment, the gear portion 103*a* has two fewer teeth than the gear portion 102*a*. The flex spline 103 is spline-coupled to the output shaft 95, which is mounted on an inner peripheral region of the input member 93 by a bearing 96 and is spline-coupled to the throttle shaft 21.

A motor 97 having a drive shaft 98 coaxial with the throttle shaft 21 is mounted to the fixed case 92. The drive shaft 98 of the motor 97 is coupled to a wave generator 100 via a joint 99. The wave generator 100 has an outer diameter appropriately varied along the axial direction thereof. The wave generator 100 is rotatably mounted by a bearing 101 to the interior of the small-diameter cylindrical portion 93*a* of the input member 93, and is rotatably mounted by bearings 104 and 105 to the interior of the flex spline 103. An oval cam portion 100*a* is provided in a position of the wave generator 100 that is on the inner peripheral side of the bearing 105. An inner ring of the bearing 105 which is a ball bearing is attached to the oval cam portion 100*a*. Therefore, the flex spline 103 is deformed in an oval shape by the wave generator 100 so that the teeth of the flex spline 105 mesh with the teeth of the circular spline 102 in a long-axis portion of the oval shape and are completely away from those of the circular spline 102 in a short-axis portion thereof.

Figure 12A:
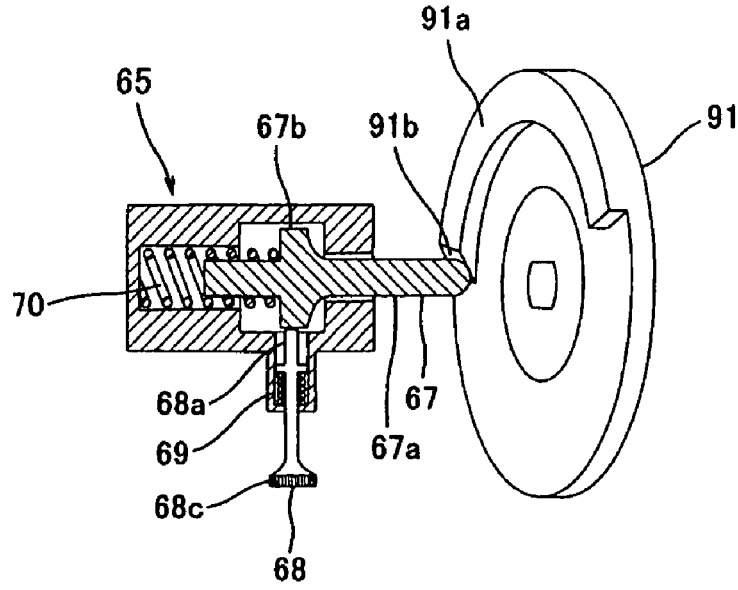
FIG. 12A is a cross-sectional view showing an extended state of a movable stopper of the throttle valve controller of FIG. 10.
Figure 12B:
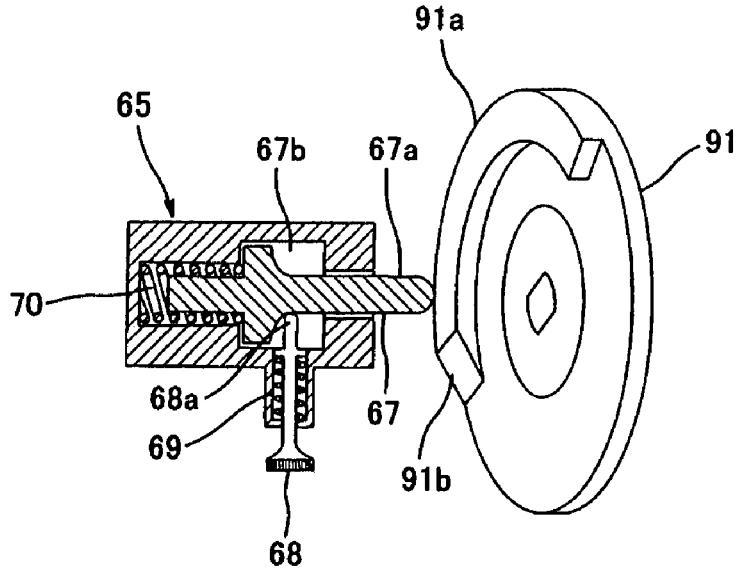
FIG. 12B is a cross-sectional view showing a retracted state of the movable stopper of the throttle valve controller of FIG. 10.

FIG. 12A is a cross-sectional view showing an extended state of the movable stopper 65 of the throttle valve controller 90. FIG. 12B is a cross-sectional view showing a retracted state of the movable stopper 65. As shown in FIG. 10 and FIG. 12A, the movable stopper 65 is mounted to the fixed case 92. The stopper portion 67 is configured to be extended and retracted in the direction substantially perpendicular to a rotational surface of the throttle pulley 91. The throttle pulley 91 has a circular-arc shaped protruding portion 91*a* on a side surface thereof that is opposite to the stopper portion 67 of the movable stopper 65. A tapered contact portion 91*b* which contacts a tip end of the stopper portion 67 has a tapered surface along which the stopper portion 67 is guided to be retracted. Since the structure of the movable stopper 65 is identical to that of the first alternative example of the first embodiment, it is referenced by the same reference numbers and will not be further described herein.

Figure 13:
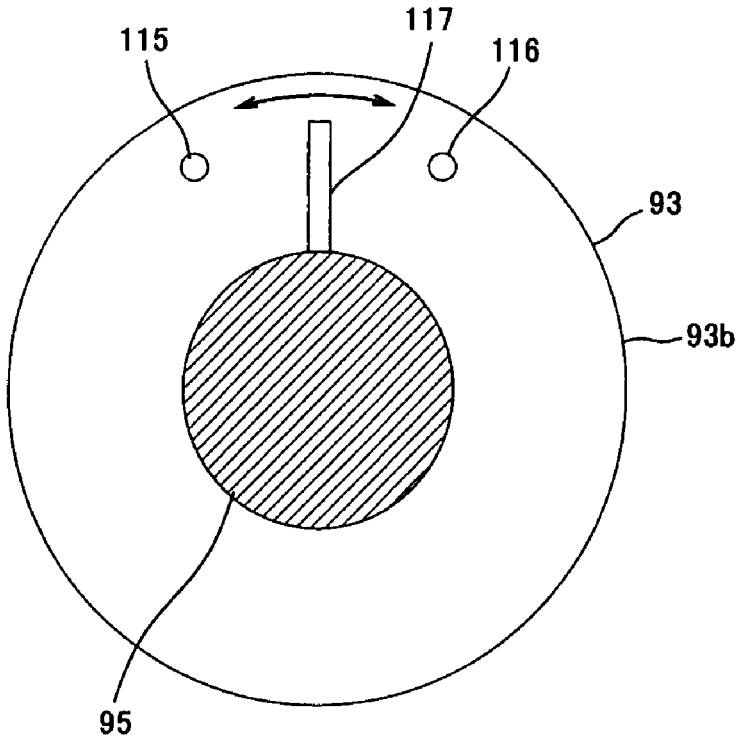
FIG. 13 is a side view schematically showing the throttle valve controller as viewed from the direction of XIII of FIG. 10.

FIG. 13 is a side view schematically showing the throttle valve controller 90 of FIG. 10 as viewed from the direction of XIII of FIG. 10. As shown in FIG. 10 and FIG. 13, a pair of opening degree restricting stoppers 115 and 116 protrudes from an end surface of the large-diameter cylindrical portion 93*b* of the input member 93 on the throttle device 13 side. A restricting bar 117 protrudes from the outer peripheral surface of the output shaft 95 radially outward between the pair of opening degree restricting stoppers 115 and 116. The opening degree restricting stopper 115 restricts an angle to which the output shaft 95 rotates counterclockwise in FIG. 13, while the opening degree restricting stopper 116 restricts an angle to which the output shaft 95 rotates clockwise in FIG. 13. That is, the output shaft 95 is restricted by the opening degree restricting stoppers 115 and 116 operative in association with the input member 93 so that a relative angle range of the output shaft 95 with respect to the input member 93 is restricted to a predetermined range. Thus, the opening and closing range of the throttle valve 22 by the motor 97 (FIG. 10) is restricted.

Subsequently, an operation of the throttle valve controller 90 will be described. As shown in FIG. 10, upon the rider's hand operation to rotate the throttle grip of the steering handle 4 (FIG. 1), the rotation is transmitted through the throttle wire W to the throttle pulley 95, which thereby rotates. Thereby, the input member 93 rotates in the corresponding direction. According to the rotation of the input member 93, the circular spline 102 rotates, causing the flex spline 103 whose gear portion 103*a* is in mesh with the gear portion 102*a* of the circular spline 102, to rotate. According to the rotation of the flex spline 103, the output shaft 95 and the throttle shaft 21 rotate, causing the throttle valve 22 to be opened and closed.

If a stopper controller (not shown) determines that the opening degree of the throttle valve 22 is required to be set to a value different from that in response to the rider's hand-operation depending on a traveling state of the motorcycle 1, the motor 97 is driven. To be specific, as shown in FIGS. 11A and 11B, when the motor 97 drives the wave generator 100 clockwise, the flex spline 103 is elastically deformed to conform in shape to the outer shape of the oval cam portion 100*a* of the wave generator 100, so that a mesh position between the flex spline 103 and the circular spline 102 sequentially shifts. As shown in FIG. 11C, when the wave generator 100 rotates once, the gear portion 103 of the flex spline 103 shifts by the two teeth in a reverse direction (counterclockwise) to the rotation of the wave generator 100, because the gear portion 103*a* of the flex spline 103 has two fewer teeth than the gear portion 102*a* of the circular spline 102. Thereby, the output shaft 95 coupled to the flex spline 103 rotates relative to the input member 93 coupled to the circular spline 102, causing the throttle valve 22 to be opened and closed. That is, by changing a rotational ratio of the output shaft 95 to the input member 93, the throttle valve 22 is automatically controlled to be opened and closed in such a manner that the throttle valve 22 is moved to an opening degree that is larger than or smaller than that resulting only from the rider's hand operation.

If the motor 97 does not correctly operate and unexpectedly stops under the state where the motor 97 is operating to cause the throttle valve 22 to be opened to an opening degree larger than that resulting only from the rider's hand-operation, the throttle valve 22 will be left open by an excess phase angle due to the stopping of the motor 97. Under this condition, the throttle valve 22 is opened by the excess phase angle and thus is unable to return to an opening degree corresponding to an idling engine speed in a normal state, even if the rider returns the throttle grip to the fully closed position of the throttle valve 22. Accordingly, as described below, the movable stopper 65 is retracted to increase a rotational range of the throttle pulley 91 in the closing direction of the throttle valve 22.

As shown in FIG. 12A, if the engine speed is more than the idling engine speed with the tapered contact portion 91*b* of the throttle pulley 91 in contact with a tip end of the stopper portion 67 and the rider determines that the engine speed is required to return to the idling engine speed, the rider rotates the throttle grip (not shown) by hand operation with a predetermined force or more in the closing direction of the throttle valve 22. Thereby, as shown in FIG. 12B, the tapered contact portion 91*b* of the throttle pulley 91 pushes in the stopper portion 67 of the movable stopper 65 outside a rotational track of the contact portion 91*b* and the stop portion 68*a* stops the flange portion 67*b*, maintaining the stopper portion 67 in a non-restricting state. By pulling the release portion 68*c* in the state where the movable stopper portion 67 is not opposite to the protruding portion 91*a* of the throttle pulley 91, the piston 68 is retracted against the spring 69 so that the flange portion 67*b* is released, causing the stopper portion 67 to be reset in an extended or protruding state, namely, a restricting state.

In the above construction, since the movable stopper 65 is able to be switched to the non-restricting state in the event of a failure of the motor 97, etc., the rider hand-operates and rotates the throttle pulley 91 freely to adjust the opening degree of the throttle valve 22. Therefore, by bringing the protruding portion 170*a* of the rotatable element 170 into contact with the idle stopper 171, the throttle valve 22 can be returned to the idling opening degree. Furthermore, even if the motor 97 excessively rotates and thereby causing the output shaft 95 to rotate a large amount, the opening degree restricting stoppers 115 and 116 restrict a relative angle range of the output shaft 95 with respect to the input member 93. Thus, the throttle valve 22 can be maintained in a suitable opening degree range.

Whereas in this embodiment the movable stopper 65 is a mechanical stopper as in the first alternative example, the electromagnetic movable stopper 30 driven by the movable stopper drive unit 48 of the first embodiment, the hydraulic movable stopper 75 of the second alternative example, the electromagnetic and mechanical stopper of the third alternative example may be employed. The same applies to the embodiments described below.

Embodiment 3

Figure 14:
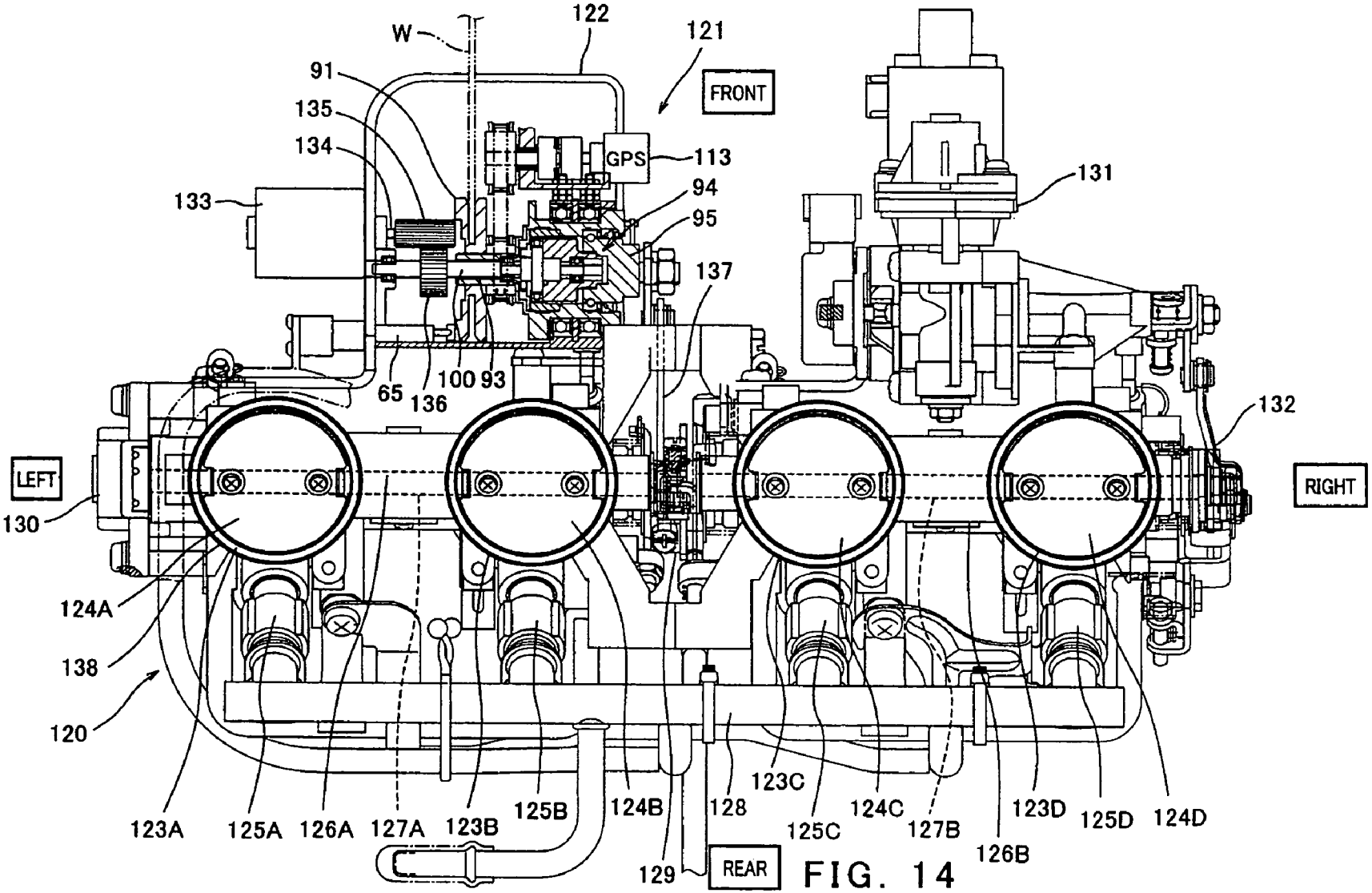
FIG. 14 is a partial cross-sectional plan view of a throttle device equipped with a throttle valve controller according to a third embodiment.

Subsequently, a third embodiment will be described. FIG. 14 is a partial cross-sectional plan view of a throttle device 120 equipped with a throttle valve controller 121 according to a third embodiment. As shown in FIG. 14, the throttle device 120 includes a throttle body 138 having first to fourth tubular air-intake portions 123A to 123D arranged from the left to the right. Fuel injectors 125A to 125D are attached on back sides of the first to fourth tubular air-intake portions 123A to 123D, respectively. A fuel supply pipe 128 is coupled to upper ends of the injectors 125A to 125D. A first spacer 126A couples the first tubular air-intake portion 123A and the second tubular air-intake portion 123B to each other. A second spacer portion 126B couples the third tubular air-intake portion 123C and the fourth tubular air-intake portion 123D to each other.

A left throttle shaft 127A is rotatably mounted to penetrate the first tubular air-intake portion 123A, the second tubular air-intake portion 123B, and the first spacer portion 126A. A right throttle shaft 127B is rotatably mounted to penetrate the third tubular air-intake portion 123C, the fourth tubular air-intake portion 123D, and the second spacer portion 126B.

Disc-shaped throttle valves 124A and 124B that are mounted on the left throttle shaft 127A are disposed in upstream regions of inner passages of the first and second tubular air-intake portions 123A and 123B. The tubular air-intake portions 123C and 123D are constructed in the same manner. FIG. 14 shows throttle valves 124C and 124D.

A synchronization member 129 is mounted in a space between the second tubular air-intake portion 123B and the third tubular air-intake portion 123C to couple the left throttle shaft 127A and the right throttle shaft 127B to each other so that the left throttle shaft 127A and the right throttle shaft 127B synchronously rotate. A throttle position sensor (valve angle sensor) 130 is coupled to the left throttle shaft 127A.

A frame-shaped bracket 122 is mounted forward of the first tubular air-intake portion 123A and the second tubular air-intake portion 123B. The throttle valve controller 121 is mounted to the bracket 122. The throttle valve controller 121 is substantially identical in construction to that of the second embodiment except for a power transmission system in which the rotational force is transmitted from a motor 133 to the wave generator 100. A first spur gear 136 is externally fittingly mounted on the wave generator 100. A drive shaft 134 of the motor 133 extends substantially in parallel with the wave generator 100. A second spur gear 135 is externally fittingly mounted on the drive shaft 134 of the motor 133 and is configured to mesh with the first spur gear 136. The drive force of the drive shaft 134 of the motor 133 is transmitted to the wave generator 100 through the second spur gear 135 and the first spur gear 136, and a desired rotation is output to the output shaft 95. The output shaft 95 is coupled to the synchronization member 129 through a link member 137. The rotational force of the output shaft 95 opens and closes the throttle valve 124A to 124D.

In the above construction, since the throttle valve controller 121 is disposed forward of the throttle device 120, a space can be opened at a shaft end side of the throttle device 120. The other construction is identical to that of the second embodiment, and will not be further described.

Embodiment 4

Figure 15:
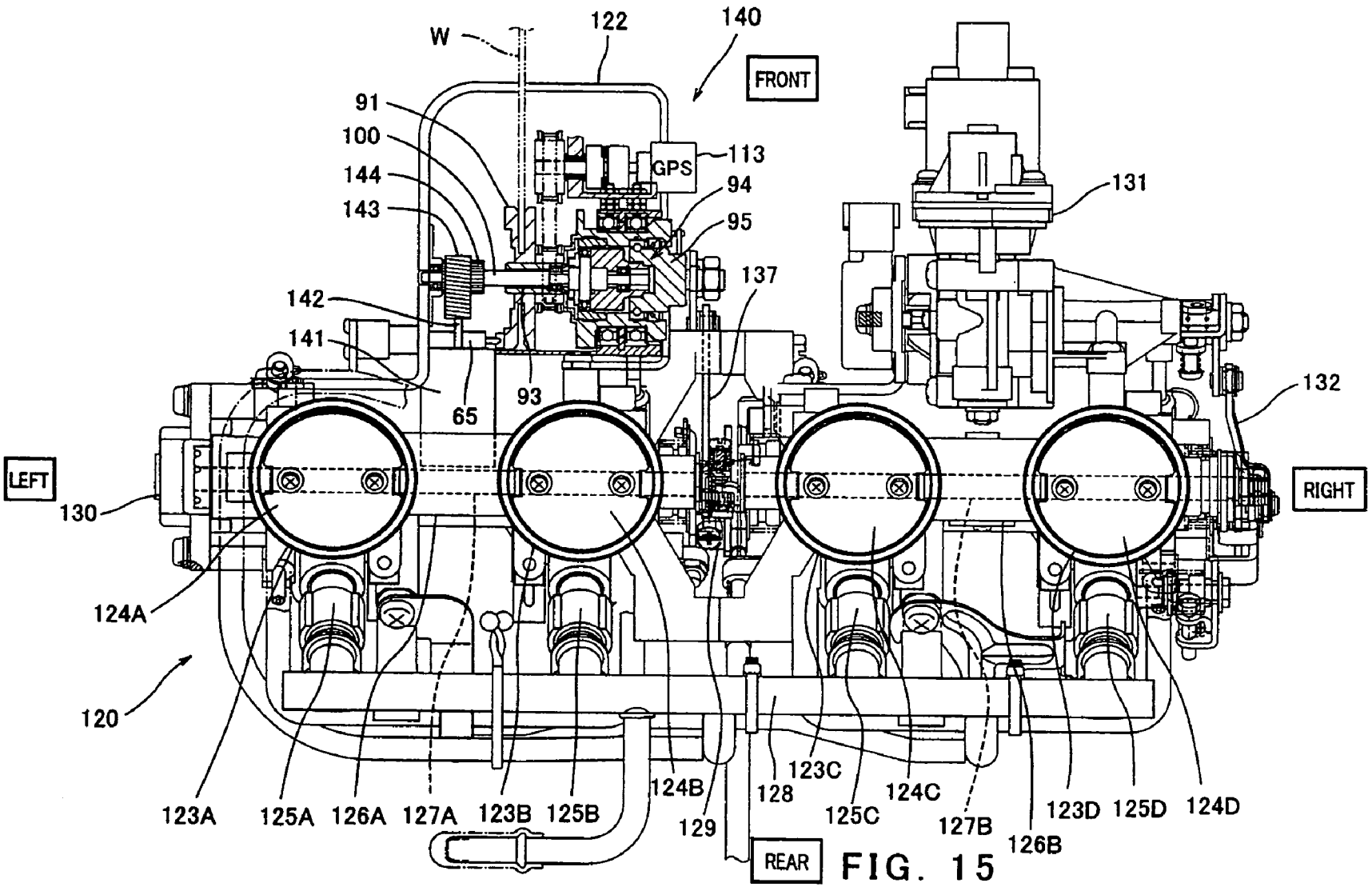
FIG. 15 is a partial cross-sectional plan view of a throttle device equipped with a throttle valve controller according to a fourth embodiment.

Subsequently, a fourth embodiment will be described. FIG. 15 is a partial cross-sectional plan view of the throttle device 120 equipped with a throttle valve controller 140 according to the fourth embodiment. The fourth embodiment is different from the third embodiment in that a motor 141 of the throttle valve controller 140 is disposed between the first tubular air-intake portion 123A and the second tubular air-intake portion 123B.

As shown in FIG. 15, the motor 141 is disposed between the first tubular air-intake portion 123A and the second tubular air-intake portion 123B in such a manner that a drive shaft 142 is oriented forward to extend in the direction substantially perpendicular to the wave generator 100. A worm gear 143 is externally fittingly mounted to a tip end of the drive shaft 142 and is in mesh with a worm wheel 144 externally fittingly mounted to the wave generator 100. The rotational force of the drive shaft 142 of the motor 141 is transmitted to the wave generator 100 through the worm gear 143 and the worm wheel 144, and a desired rotational force is output to the output shaft 95. The output shaft 95 is coupled to the synchronization member 129 through the link member 137. The rotational force of the output shaft 95 opens and closes the throttle valves 124A to 124D.

In the above construction, since the motor 141 is disposed between adjacent tubular air-intake portions 123A and 123B of the throttle body 138, the motor 141 does not protrude greatly from the throttle device 120. The size of the apparatus can be reduced as a whole. The other components are identical to those of the third embodiment, and will not be further described herein.

Embodiment 5

Figure 16:
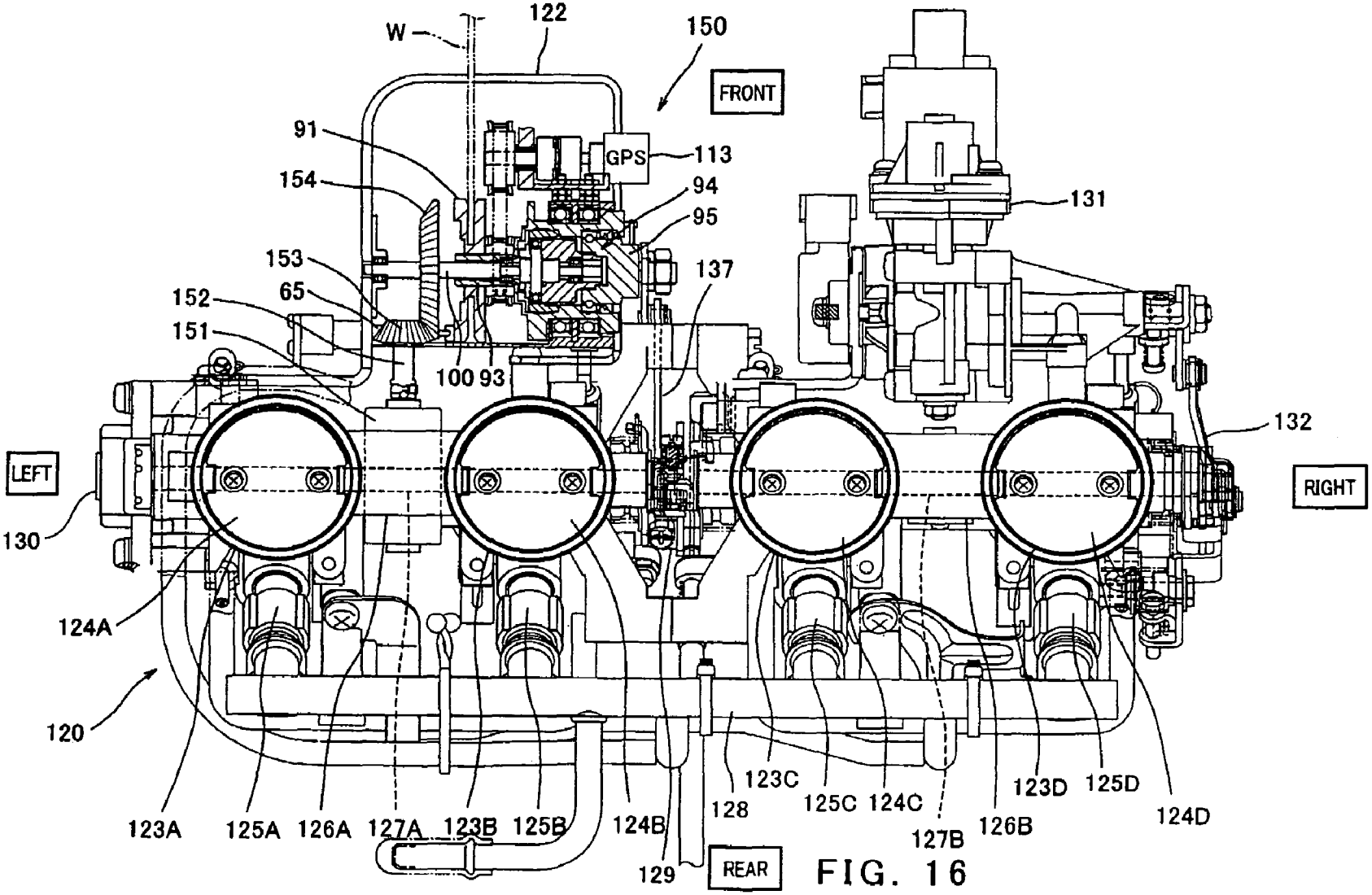
FIG. 16 is a partial cross-sectional plan view of a throttle device equipped with a throttle valve controller according to a fifth embodiment.

Subsequently, a fifth embodiment will be described. FIG. 16 is a partial cross-sectional plan view of the throttle device 120 equipped with a throttle valve controller 150 according to a fifth embodiment. The fifth embodiment differs from the fourth embodiment in that a motor 151 of the throttle valve controller 150 is mounted to penetrate a first spacer portion 126A between the first tubular air-intake portion 123A and the second tubular air-intake portion 123B.

As shown in FIG. 16, the motor 151 is inserted into a penetrating hole (not shown) of the first spacer portion 126A between the first tubular air-intake portion 123A and the second tubular air-intake portion 123B. A drive shaft 152 of the motor 151 is oriented forward to extend in the direction substantially perpendicular to the wave generator 100. A first bevel gear 153 is externally fittingly mounted on a tip end of the drive shaft 152. The first bevel gear 153 is in mesh with a second bevel gear 154 externally fittingly mounted to the wave generator 100. In this construction, the rotational force of the drive shaft 152 of the motor 151 is transmitted to the wave generator 100 through the first bevel gear 153 and the second bevel gear 154, and a desired rotation is output to the output shaft 95. The output shaft 95 is coupled to the synchronization member 129 through the link member 137. The rotational force of the output shaft 95 opens and closes the throttle valves 124A to 124D. The other components are identical to those of the fourth embodiment, and will not be further described.

Embodiment 6

Figure 17:
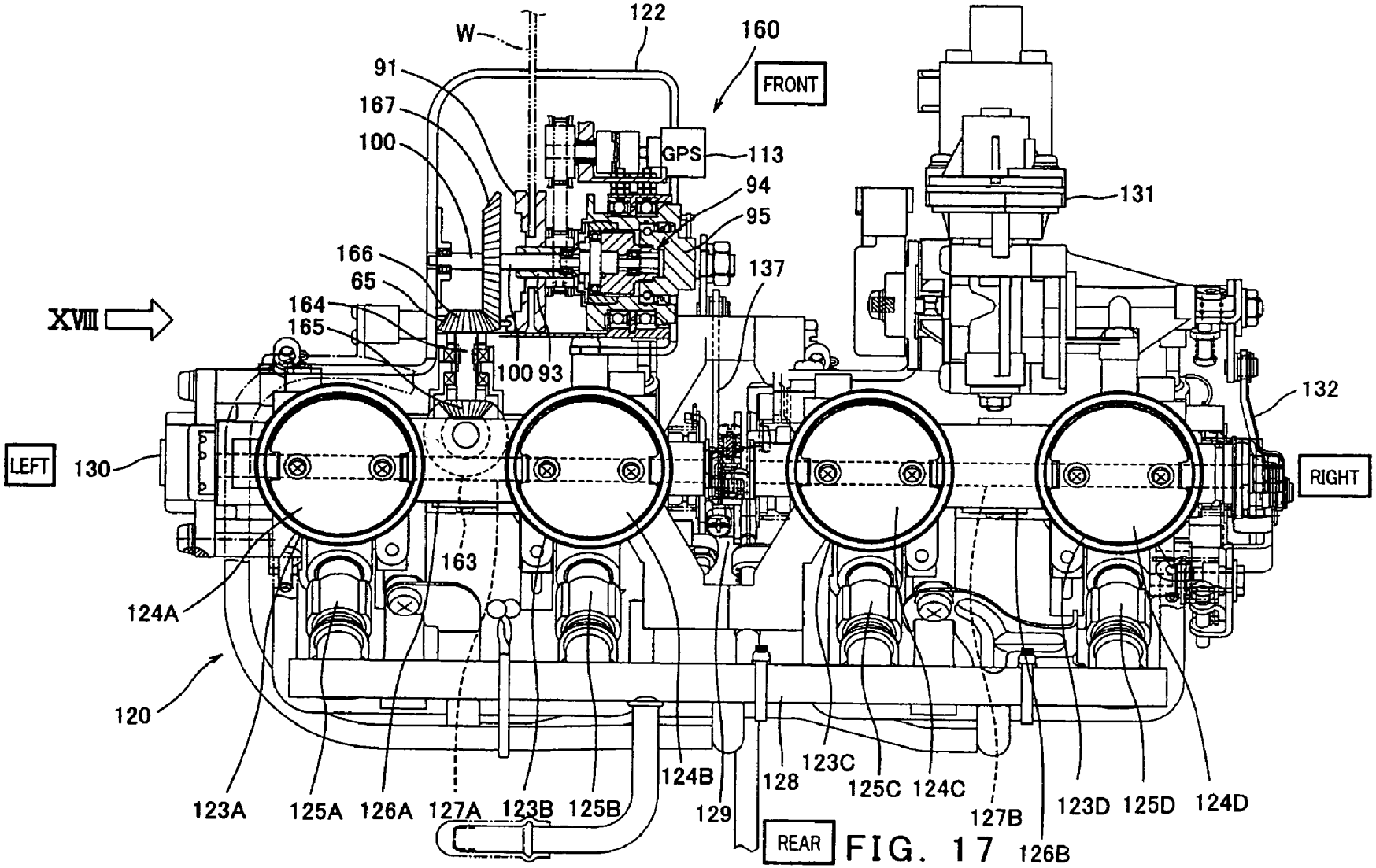
FIG. 17 is a partial cross-sectional plan view of a throttle device equipped with a throttle valve controller according to a sixth embodiment.
Figure 18:
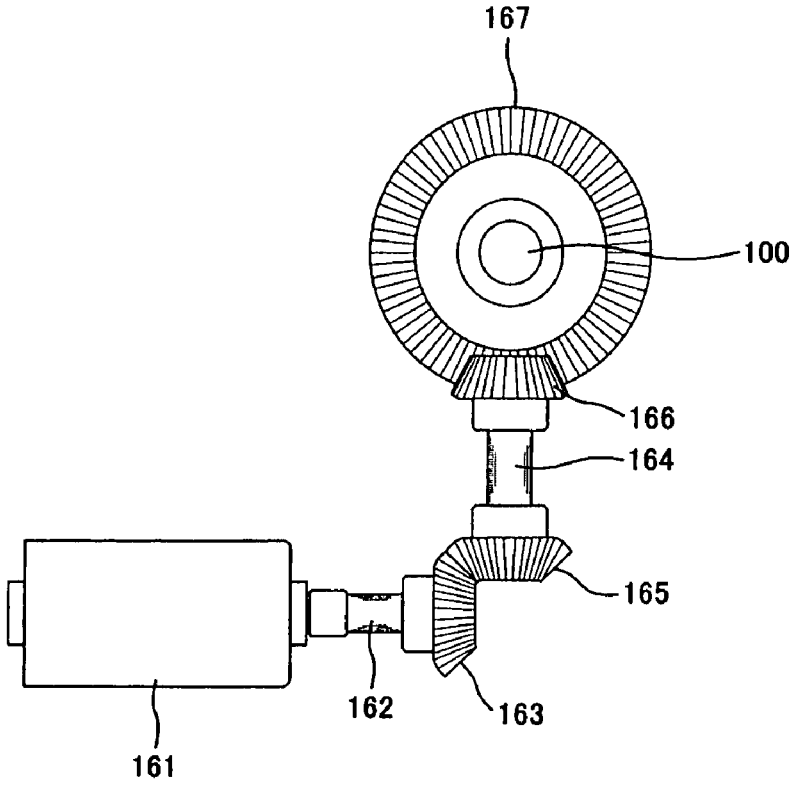
FIG. 18 is a side view of the throttle valve controller as viewed from the direction of XVIII of FIG. 17.

A sixth embodiment of the present invention will be described. FIG. 17 is a partial cross-sectional plan view of the throttle device 120 equipped with a throttle valve controller 160 according to a sixth embodiment. FIG. 18 is a side view of the throttle valve controller 160 as viewed from the direction of XIII of FIG. 17. The sixth embodiment differs from the fifth embodiment in that a motor 161 of the throttle valve controller 160 is disposed to protrude in the intake-air flow direction (vertical direction) between the first tubular air-intake portion 123A and the second tubular air-intake portion 123B.

As shown in FIGS. 17 and 18, the motor 161 is disposed downstream of the first spacer portion 126A in the intake-air flow direction. A drive shaft 162 of the motor 161 is disposed substantially along the first spacer 126A in the intake-air flow direction. A first bevel gear 163 is externally fittingly mounted on a tip end of the drive shaft 162. A relay shaft 164 is disposed forward of the first spacer portion 162 to extend in the direction substantially perpendicular to the wave generator 100. A second bevel gear 165 is mounted on a rear end portion of the relay shaft 164 and is configured to mesh with the first bevel gear 163. A third bevel gear 166 is mounted on a front end portion of the relay shaft 164. A fourth bevel gear 167 is externally fittingly mounted to the wave generator 100 and is configured to mesh with the third bevel gear 166.

In the above construction, the force of the drive shaft 162 of the motor 161 is transmitted to the generator 100 through the first bevel gear 163, the second bevel gear 165, the relay shaft 164, the third bevel gear 166, and the fourth bevel gear 167, and a desired rotation is output to the output shaft 95. The output shaft 95 is coupled to the synchronization member 129 through the link member 137. The rotational force of the output shaft 95 opens and closes the throttle valves 124A to 124D. The other components are identical to those of the third embodiment, and will not be further described.

The throttle valve controller of the present invention is applicable to vehicles such as all terrain vehicles or personal watercraft (PWC) as well as motorcycles.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A throttle valve controller configured to control opening and closing of a throttle valve disposed in an air-intake passage of a throttle body coupled to an engine, the throttle valve controller comprising:

an input member including a rotatable hand grip that is rotatable in association with a rider's hand operation;

a power transmission device with an input part thereof coupled to the input member;

an output member that is coupled to an output part of the power transmission device and causes the throttle valve to rotate in association therewith;

an actuator configured to drive the power transmission device to cause the output member to rotate relative to the input member to change a rotational ratio of the output member to the input member independently of the rider's hand operation; and a movable stopper configured to change and restrict a rotational range of the input member in a closing direction of the throttle valve;

wherein the movable stopper is configured to be able to be switched from a restricting state that restricts the rotational range of the input member to a non-restricting state that does not contact a component that is rotatable in association with a rider's hand operation, and therefore does not restrict the rotational range.

2. The throttle valve controller according to claim 1, wherein the movable stopper is configured to contact a contact portion rotatable integrally with the input member to restrict rotation of the input member in the restricting state and is configured to be retracted from a rotational track of the contact portion outside the rotational track in the non-restricting state.

3. A throttle valve controller configured to control opening and closing of a throttle valve disposed in an air-intake passage of a throttle body coupled to an engine, the throttle valve controller comprising:

an input member including a rotatable hand grip that is rotatable in association with a rider's hand operation;

a power transmission device with an input part thereof coupled to the input member;

an output member that is coupled to an output part of the power transmission device and causes the throttle valve to rotate in association therewith;

an actuator configured to drive the power transmission device to cause the output member to rotate relative to the input member to change a rotational ratio of the output member to the input member independently of the rider's hand operational and a movable stopper configured to change and restrict a rotational range of the input member in a closing direction of the throttle valve;

wherein the movable stopper is configured to contact a contact portion rotatable integrally with the input member to restrict rotation of the input member and is configured to be retracted in the closing direction of the throttle valve on a rotational track of the contact portion, wherein the movable stopper is configured to be retracted by a predetermined pressing force applied from the contact portion and to maintain a retracted state, and is configured to be extended to be in a restricting state that restricts the rotational range of the input shaft by a return member for releasing the retracted state of the movable stopper.

4. The throttle valve controller according to claim 3 wherein the movable stopper includes a stopper portion configured to be applied with a force to be in an extended state; a stop portion configured to stop the stopper portion in the retracted state when the stopper portion is retracted against the force; and a release portion configured to serve as the return member, the release portion being configured to be operated by a rider's hand to release the stop state of the stop portion.

5. The throttle valve controller according to claim 3 wherein the movable stopper includes a hydraulic cylinder, a stopper portion that is extensible and retractable by an oil pressure of the hydraulic cylinder; a first relief valve configured to outflow oil from the hydraulic cylinder to cause the stopper portion to be retracted when a pressing force is applied from the contact portion to the stopper portion; and a second relief valve configured to inflow the oil into the hydraulic cylinder to cause the stopper portion to be extended by a load of a return piston serving as the return member and being configured to be operated by a rider's hand.

6. A throttle valve controller configured to control opening and closing of a throttle valve disposed in an air-intake passage of a throttle body coupled to an engine, the throttle valve controller comprising:

an input member including a rotatable hand grip that is rotatable in association with a rider's hand operation;

a power transmission device with an input part thereof coupled to the input member;

an output member that is coupled to an output part of the power transmission device and causes the throttle valve to rotate in association therewith;

an actuator configured to drive the power transmission device to cause the output member to rotate relative to the input member to change a rotational ratio of the output member to the input member independently of the rider's hand operation;

a movable stopper configured to change and restrict a rotational range of the input member in a closing direction of the throttle valve;

a hand-operation angle sensor configured to detect a rotational angle of the input member;

a valve angle sensor configured to detect an actual rotational angle of the throttle valve;

a valve opening degree calculator configured to calculate and determine a target opening degree of the throttle valve based on a detected value from the hand-operation angle sensor;

a movable stopper drive unit configured to extend and retract the movable stopper; and a stopper controller configured to cause the movable stopper drive unit to move the movable stopper to increase a rotational range in the closing direction of the throttle valve when the target opening degree calculated by the valve opening degree calculator is a fully closed position and the actual rotational angle of the throttle valve that is detected by the valve angle sensor is an opening degree more than a predetermined angle.

7. The throttle valve controller according to claim 6, wherein the movable stopper is configured to be retracted by a predetermined pressing force applied from a contact portion rotatable integrally with the input member, irrespective of an operation of the movable stopper drive unit.

8. A throttle valve controller configured to control opening and closing of a throttle valve disposed in an air-intake passage of a throttle body coupled to an engine, the throttle valve controller comprising:

an input member including a rotatable hand grip that is rotatable in association with a rider's hand operation;

a power transmission device with an input part thereof coupled to the input member;

an output member that is coupled to an output part of the power transmission device and causes the throttle valve to rotate in association therewith;

an actuator configured to drive the power transmission device to cause the output member to rotate relative to the input member to change a rotational ratio of the output member to the input member independently of the rider's hand operation; and a movable stopper configured to change and restrict a rotational range of the input member in a closing direction of the throttle valve;

wherein the actuator has a drive shaft configured to transmit a rotational force to the output member through a worm gear;

wherein the power transmission device includes a rotatable frame that is rotatable in association with the input member; a swing shaft that is rotatably mounted inside the rotatable frame to extend in a direction perpendicular to a rotational axis of the rotatable frame; a relay bevel gear mounted on the swing shaft; and an output bevel gear that is mounted on the output member and is configured to mesh with the relay bevel gear; and wherein the worm gear is disposed between the drive shaft of the actuator and the swing shaft.

9. An engine comprising:

a throttle valve controller configured to control opening and closing of a throttle valve disposed in an air-intake passage of a throttle body coupled to the engine, the throttle valve controller including:

an input member including a rotatable hand grip that is rotatable in association with a rider's hand operation;

a power transmission device with an input part thereof coupled to the input member;

an output member that is coupled to an output part of the power transmission device and causes the throttle valve to rotate in association therewith;

an actuator configured to drive the power transmission device to cause the output member to rotate relative to the input member to change a rotational ratio of the output member to the input member independently of the rider's hand operation; and a movable stopper configured to change and restrict a rotational range of the input member in a closing direction of the throttle valve;

wherein the movable stopper is configured to be able to be switched from a restricting state that restricts the rotational range of the input member to a non-restricting state that does not contact a component that is rotatable in association with a rider's hand operation, and therefore does not restrict the rotational range.

* * * * *